US012631347B2

(12) United States Patent
Guo

(10) Patent No.: US 12,631,347 B2
(45) Date of Patent: May 19, 2026

(54) FRESH AIR PANEL ASSEMBLY, AIR CONDITIONER INDOOR UNIT, AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Quluan Guo, Foshan (CN)

(73) Assignees: GD MIDEA AIR-CONDITIONING EQUIPMENT CO., LTD., Foshan (CN); MIDEA GROUP CO., LTD, Foshan (CN)

( * ) Notice: Subject to any disclaimer, the term of this patent is extended or adjusted under 35 U.S.C. 154(b) by 942 days.

(21) Appl. No.: 17/433,773

(22) PCT Filed: Oct. 22, 2019

(86) PCT No.: PCT/CN2019/112436

§ 371 (c)(1),
(2) Date: Aug. 25, 2021

(87) PCT Pub. No.: WO2020/177328

PCT Pub. Date: Sep. 10, 2020

(65) Prior Publication Data

US 2022/0136713 A1 May 5, 2022

(30) Foreign Application Priority Data

Mar. 3, 2019 (CN) ..... 201910159400.X
Mar. 3, 2019 (CN) ..... 201920267900.0

(51) Int. Cl.
*F24F 1/0007* (2019.01)
*F24F 1/0043* (2019.01)
(Continued)

(52) U.S. Cl.
CPC ..... *F24F 1/0007* (2013.01); *F24F 1/0043* (2019.02); *F24F 13/084* (2013.01); *F24F 13/20* (2013.01)

(58) Field of Classification Search
CPC ..... F24F 1/0007; F24F 1/0043; F24F 13/084; F24F 13/20; F24F 1/0014; F24F 1/35; F24F 1/0011
(Continued)

(56) References Cited

U.S. PATENT DOCUMENTS 4,835,981 A * 6/1989 Rinholen ..... F24F 1/022 62/262
2010/0201232 A1* 8/2010 Gajina ..... F24F 13/20 411/103
(Continued)

FOREIGN PATENT DOCUMENTS

CN 204901957 U 12/2015
CN 105865003 A 8/2016
(Continued)

OTHER PUBLICATIONS

The China National Intellectual Property Administration (CNIPA) The First Office Action for Chinese Application 202210737799.7 Nov. 15, 2023 29 Pages (With Translation).
(Continued)

*Primary Examiner* — Michael G Hoang
*Assistant Examiner* — Frances F. Hamilton
(74) *Attorney, Agent, or Firm* — Anova Law Group, PLLC

(57) ABSTRACT

A fresh air panel assembly includes a fresh air panel and a mounting plate. The fresh air panel includes an air outlet structure. The mounting plate includes a vent penetrating through the mounting plate. The fresh air panel is mounted
(Continued)

at a surface of the mounting plate. The vent is arranged corresponding to the air outlet structure.

18 Claims, 21 Drawing Sheets

(51) Int. Cl.
*F24F 13/08* (2006.01)
*F24F 13/20* (2006.01)

(58) Field of Classification Search
USPC ..... 454/339, 241
See application file for complete search history.

(56) References Cited

U.S. PATENT DOCUMENTS

| | | | | |
|---|---|---|---|---|
| 2010/0206514 | A1* | 8/2010 | Liu | F24F 1/0047 165/67 |
| 2015/0090429 | A1* | 4/2015 | Jeong | F24F 13/20 454/292 |
| 2016/0105996 | A1* | 4/2016 | Schanzenbach | H02B 1/565 415/121.2 |
| 2017/0115028 | A1* | 4/2017 | Lee | B01D 46/523 |
| 2019/0219278 | A1* | 7/2019 | Lee | F24F 13/15 |
| 2021/0215389 | A1* | 7/2021 | Chun | F24F 1/005 |
| 2021/0389019 | A1* | 12/2021 | Lv | F24F 13/20 |
| 2023/0013394 | A1* | 1/2023 | Zhou | F24F 8/10 |
| 2023/0016042 | A1* | 1/2023 | Zhou | F24F 1/0035 |
| 2023/0016748 | A1* | 1/2023 | Zhou | F24F 1/0073 |

FOREIGN PATENT DOCUMENTS

| | | | | | |
|---|---|---|---|---|---|
| CN | 106288274 | A | * | 1/2017 | F24F 1/0011 |
| CN | 206131375 | U | * | 4/2017 | |
| CN | 206160403 | U | | 5/2017 | |
| CN | 107490078 | A | * | 12/2017 | |
| CN | 207035321 | U | | 2/2018 | |
| CN | 207146553 | U | | 3/2018 | |
| CN | 108105883 | A | | 6/2018 | |
| CN | 207688250 | U | | 8/2018 | |
| CN | 109282358 | A | * | 1/2019 | F24F 1/0014 |
| CN | 208431916 | U | | 1/2019 | |
| CN | 109827315 | A | * | 5/2019 | |
| CN | 209672569 | U | | 11/2019 | |
| EP | 3734170 | A1 | * | 11/2020 | F24F 1/0007 |
| EP | 3901534 | A1 | * | 10/2021 | F16B 5/0614 |
| JP | H08200727 | A | | 8/1996 | |
| JP | H0914746 | A | | 1/1997 | |
| JP | H1078254 | A | | 3/1998 | |
| JP | 2005164162 | A | | 6/2005 | |
| KR | 20130055293 | A | * | 5/2013 | F24F 13/20 |
| WO | 2019033610 | A1 | | 2/2019 | |
| WO | 2020177327 | A1 | | 9/2020 | |

OTHER PUBLICATIONS

The China National Intellectual Property Administration (CNIPA) The First Office Action for Chinese Application 202210738394.5 Nov. 1, 2023 24 Pages (With Translation).
The China National Intellectual Property Administration (CNIPA) The First Office Action for Chinese Application 202210738395.X Oct. 29, 2023 14 Pages (With Translation).
Japan Patent Office (JPO) Decision of Refusal For JP Application No. 2019-564879 Feb. 8, 2022 13 Pages (Translation Included).
Japan Patent Office (JPO) Decision to Grant a Patent For JP Application No. 2019-564879 Jun. 7, 2022 5 Pages (Translation Included).
Yongzhang Yu et al., "Positive Displacement Compressor Technical Manual", Nov. 2000, China Machines Press, China.
Manying Lin , "Plastic Molding Product Design And Mold Making", Jan. 2012, National Defense Industry Press, China.
World Intellectual Property Organization (WIPO) International Search Report and Written opinion for PCT/CN2019/112436 Jan. 17, 2020 16 Pages (Translation Included).
Japan Patent Office (JPO) The First Office Action For JP Application No. 2019-564879 Jun. 22, 2021 10 Pages (Translation Included).
The European Patent Office (EPO) Extended Search Report for EP Application No. 19798516.1 Oct. 20, 2020 7 Pages.
China National Intellectual Property Administration (CNIPA) Office Action 1 for Application No. 201910159400.X Dec. 13, 2024 22 Pages (including translation).

* cited by examiner

FRESH AIR PANEL ASSEMBLY, AIR CONDITIONER INDOOR UNIT, AND AIR CONDITIONER

CROSS-REFERENCE TO RELATED APPLICATIONS

The present application is a National Stage Entry under 35 U.S.C. § 371 of International Application No. PCT/CN2019/112436, filed on Oct. 22, 2019, which claims priority to Chinese Patent Application Nos. 201920267900.0 and 201910159400.X, both entitled "FRESH AIR PANEL ASSEMBLY, AIR CONDITIONER INDOOR UNIT, AND AIR CONDITIONER" and filed on Mar. 3, 2019, which are hereby incorporated by reference in their entirety.

TECHNICAL FIELD

The present disclosure relates to the technical field of air conditioning, and in particular, to a fresh air panel assembly, an air conditioner indoor unit, and an air conditioner.

BACKGROUND

In the related art, an air conditioner indoor unit includes a fresh air module. The fresh air module includes a fresh air panel having an air outlet structure. Specifically, a fresh air vent corresponding to an air outlet passage of the fresh air module is required to be formed in a unit panel. The air outlet structure of the fresh air panel is arranged corresponding to the fresh air vent when the fresh air panel is installed on the unit panel.

During the production process, different parts of the fresh air panel need to be processed differently. For example, it is necessary to spray the inner and outer surfaces of the fresh air panel, and plate the periphery of the fresh air panel to meet different design requirements. However, since the fresh air panel is an integrated member, different processes on the fresh air panel are not only troublesome, but also may cause conflicts.

Note: the above statements merely provide background information related to the present disclosure and do not necessarily constitute prior art. Moreover, in related technology, the air outlet structure corresponding to the air outlet passage of the fresh air module is directly formed at the unit panel, and no fresh air panel is provided.

SUMMARY

The main objective of the present disclosure is to provide a fresh air panel assembly, which aims to solve the technical problem that it is difficult to perform different process treatments on the integrated fresh air panel in the related art.

In order to achieve the above objective, the present disclosure provides a fresh air panel assembly, including:

a fresh air panel having an air outlet structure; and a mounting plate, the fresh air panel is mounted at a surface of the mounting plate, the mounting plate includes a vent penetrating through the mounting plate, and the vent is arranged corresponding to the air outlet structure.

The present disclosure further provides an air conditioner indoor unit, including a housing having a fresh air vent, and a fresh air panel assembly mounted at the housing. The fresh air panel assembly includes a fresh air panel having an air outlet structure, and a mounting plate.

The fresh air panel is mounted at a surface of the mounting plate, the mounting plate includes a vent penetrating through the mounting plate, the vent is arranged corresponding to the air outlet structure, and the vent is arranged corresponding to the fresh air vent.

The present disclosure further provides an air conditioner, including an outdoor unit, and an indoor unit connected to the outdoor unit. The air conditioner indoor unit, including:

a housing having a fresh air vent; and a fresh air panel assembly mounted at the housing. The fresh air panel assembly includes a fresh air panel having an air outlet structure, and a mounting plate. The fresh air panel is mounted at a surface of the mounting plate, the mounting plate includes a vent penetrating through the mounting plate, the vent is arranged corresponding to the air outlet structure, and the vent is arranged corresponding to the fresh air vent.

The present disclosure provides a fresh air panel assembly, an air conditioner indoor unit, and an air conditioner. The fresh air panel assembly includes a fresh air panel having an air outlet structure, and a mounting plate. The fresh air panel is mounted at a surface of the mounting plate, the mounting plate includes a vent penetrating through the mounting plate, and the vent is arranged corresponding to the air outlet structure. As such, the fresh air panel and the mounting plate can be separately processed when the fresh air panel assembly includes the fresh air panel and the mounting panel that are separately connected to each other, to simplify the processing of fresh air panel assembly and improve production efficiency while meeting different design requirements.

BRIEF DESCRIPTION OF THE DRAWINGS

In order to more clearly illustrate the embodiments of the present disclosure or the technical solutions in the related art, the drawings used in the embodiments or the related art will be briefly described below. Obviously, the drawings in the following description are only some embodiments of the present disclosure. It will be apparent to those skilled in the art that other figures can be obtained from the structures illustrated in the drawings without inventive effort.

DESCRIPTION OF REFERENCE NUMERALS

| Label | Name | Label | Name |
|---|---|---|---|
| 100 | Air conditioner indoor unit | 22 | Mounting plate |
| 10 | Housing | 221 | Vent |
| 11 | Unit panel | 222 | Base plate |
| 111 | Fresh air vent | 223 | Decorative side plate |
| 112 | Slot | 224 | Clamp hole |
| 113 | Positioning protrusion | 2241 | Latch protrusion |
| 114 | Receiving groove | 2242 | Mounting gap |
| 115 | Sealing ring protrusion | 225 | Anti-falling groove |
| 20 | Fresh air panel assembly | 226 | Alignment groove |
| 21 | Fresh air panel | 2261 | Guiding inner side wall |
| 211 | Air outlet structure | 227 | Anti-disengagement protrusion |
| 212 | Clamp protrusion | 228 | Reinforcement groove |
| 2121 | Connection protrusion | 229 | Tongue |
| 2122 | Limit protrusion | 2291 | Tongue root member |
| 2123 | Clamp groove | 2292 | Insertion member |
| 2124 | Reinforcement protrusion | 2030 | Buckle |
| 213 | Anti-falling protrusion | 2031 | Positioning groove |
| 214 | Hook | 2032 | Magnetic mounting groove |
| 2141 | Support protrusion | 2033 | Magnetic member through hole |
| 2142 | Blocking protrusion | 2034 | Magnetic mounting boss |
| 21421 | Anti-disengagement groove | 2035 | Sealing ring groove |
| 2143 | Hook groove | 31 | First magnetic member |
| 215 | Reinforcement rib | 32 | Second magnetic member |
| 216 | Abutting protrusion | 40 | Fresh air module |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure.

It is to be understood that, all of the directional instructions in the embodiments of the present disclosure (such as top, bottom, left, right, front, rear . . . ) are only be used for explaining relative position relations, moving condition of the elements under a special form (referring to figures), and so on, if the special form changes, the directional instructions changes accordingly.

Besides, the meaning of "and/or" appearing in the full text includes three parallel schemes. "A and/or B" is taken as an example, including the A scheme, or the B scheme, or the scheme in which both A and B are satisfied. In addition, the technical solution of each embodiment can be combined with each other, however the technical solution must base on that the ordinary skill in that art can realize the technical solution, when the combination of the technical solutions is contradictory or cannot be realized, it should be considered that the combination of the technical solutions does not exist, and is beyond the protection scope of the present application.

Figure 3:
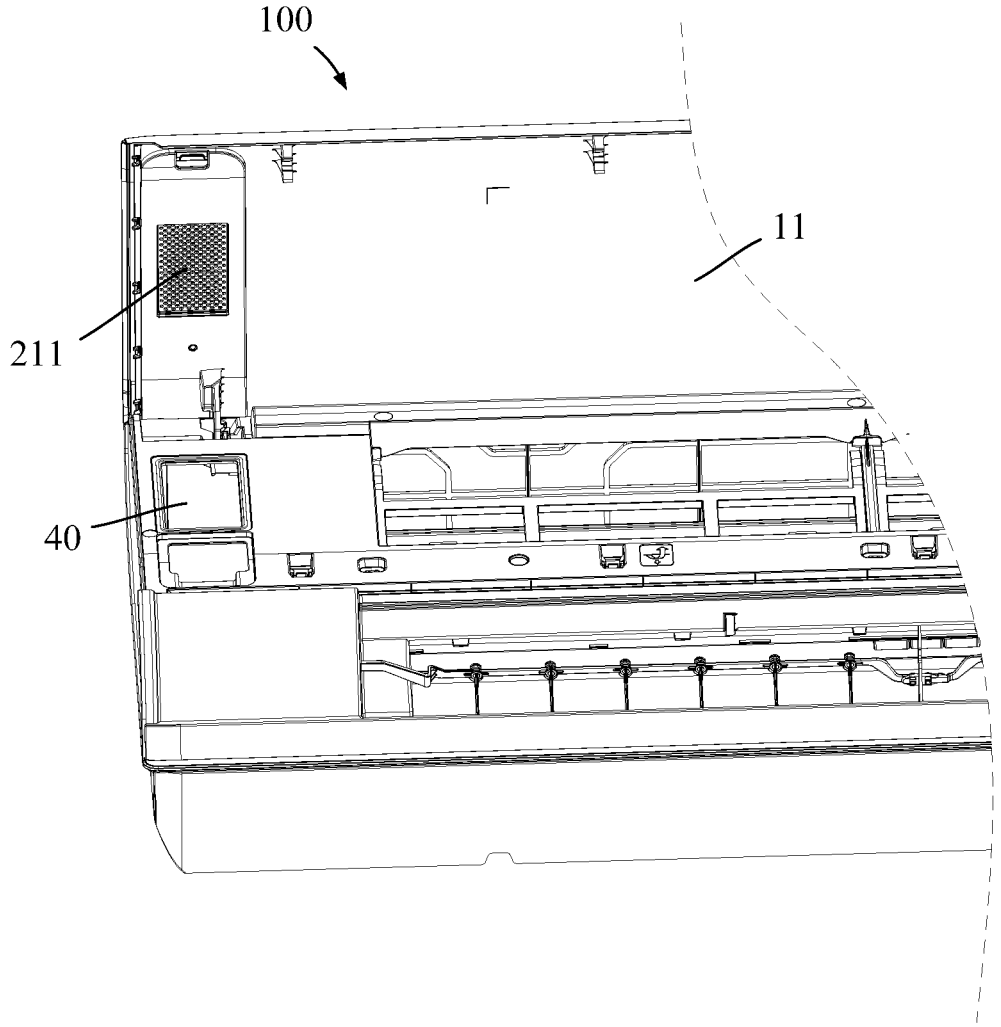
FIG. 3 is a schematic structural diagram of the air conditioner indoor unit in FIG. 1 when the unit panel is in an open state.

The present disclosure provides an air conditioner indoor unit. As shown in FIG. 3, the air conditioner indoor unit includes a fresh air module. The fresh air module is configured to introduce outdoor air into the room (i.e., to deliver fresh air to the room) to provide continuous and fresh air (i.e., fresh air) to the enclosed indoor space, thereby increasing the oxygen content of the indoor air and reducing the air conditioning disease. Optionally, the fresh air module may also be configured to exhaust air from the room.

Optionally, the fresh air module includes a fresh air shell (not shown) installed in a housing of the indoor unit, and a fresh air fan assembly (not shown) installed in the fresh air shell. The fresh air shell has a fresh air inlet and a fresh air outlet, and the fresh air inlet is connected to the outdoor, and the fresh air outlet is connected to the indoor. The fresh air inlet is in communication with the fresh air outlet, and the fresh air fan assembly is located between the fresh air inlet and the fresh air outlet to be configured to provide power for fresh air flow.

It should be understood that the air conditioner indoor unit may be a cabinet machine, or a ceiling machine, or a wall-mounted air conditioner indoor unit, or a vertical air conditioner indoor unit, etc. Hereinafter, a wall-mounted air conditioner indoor unit will be described as an example, but it is not limited to the wall-mounted air conditioner indoor unit.

In an embodiment of the present disclosure, as shown in FIGS. 1-3, 17, 18, 20 and 21, the air conditioner indoor unit includes:

a housing 10 having a fresh air vent 111; and a fresh air panel assembly having an air outlet structure 211; the fresh air panel assembly 20 is mounted at the housing 10, and the air outlet structure 211 is arranged corresponding to the fresh air vent 111.

Specifically, the fresh air outlet 111 is an outlet for fresh air. The fresh air panel assembly 20 is mounted at the housing 10 to cover the fresh air outlet 111 to achieve dust prevention. Moreover, by providing the air outlet structure 211 corresponding to the fresh air outlet 111 on the fresh air panel assembly 20, the fresh air can be processed to meet different user requirements.

Figure 1:
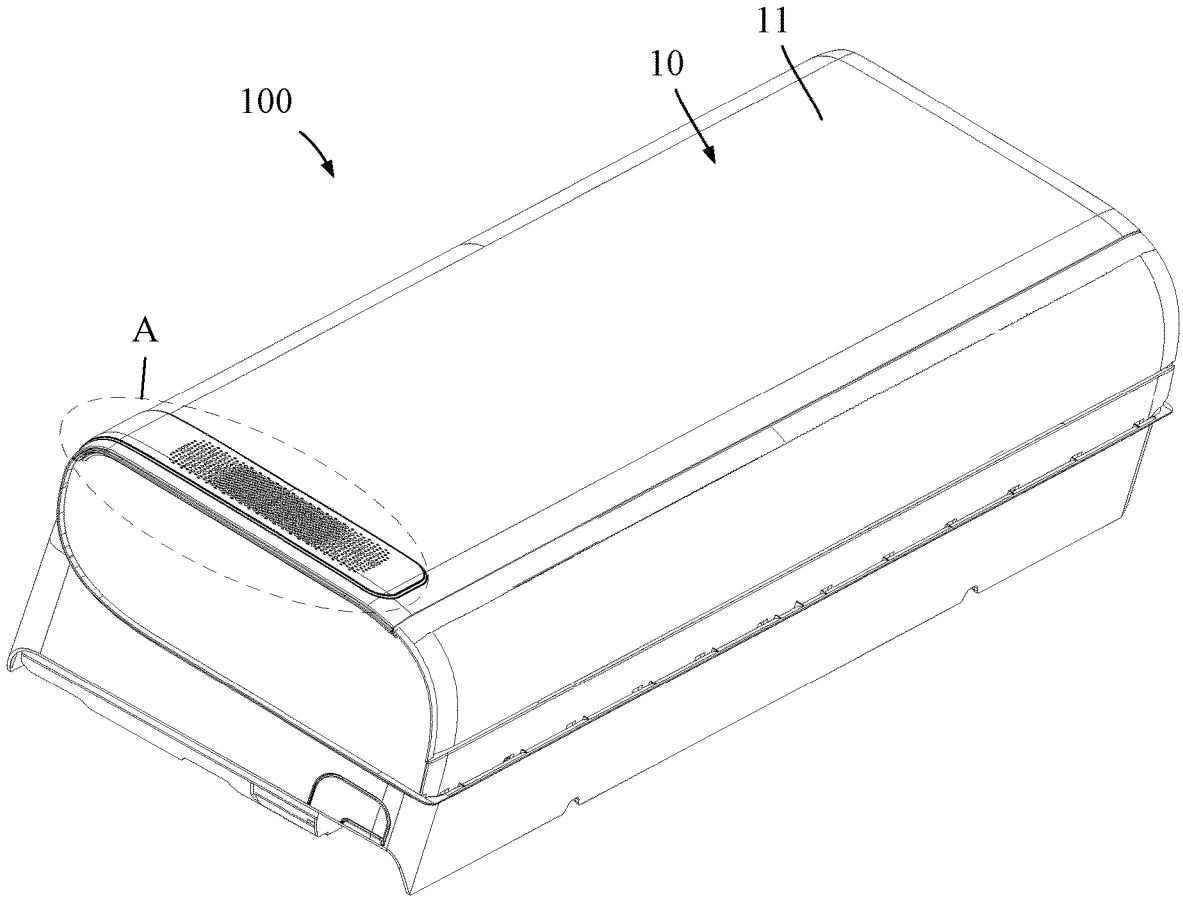
FIG. 1 is a schematic structural diagram of an air conditioner indoor unit according to an embodiment of the present disclosure.
Figure 2:
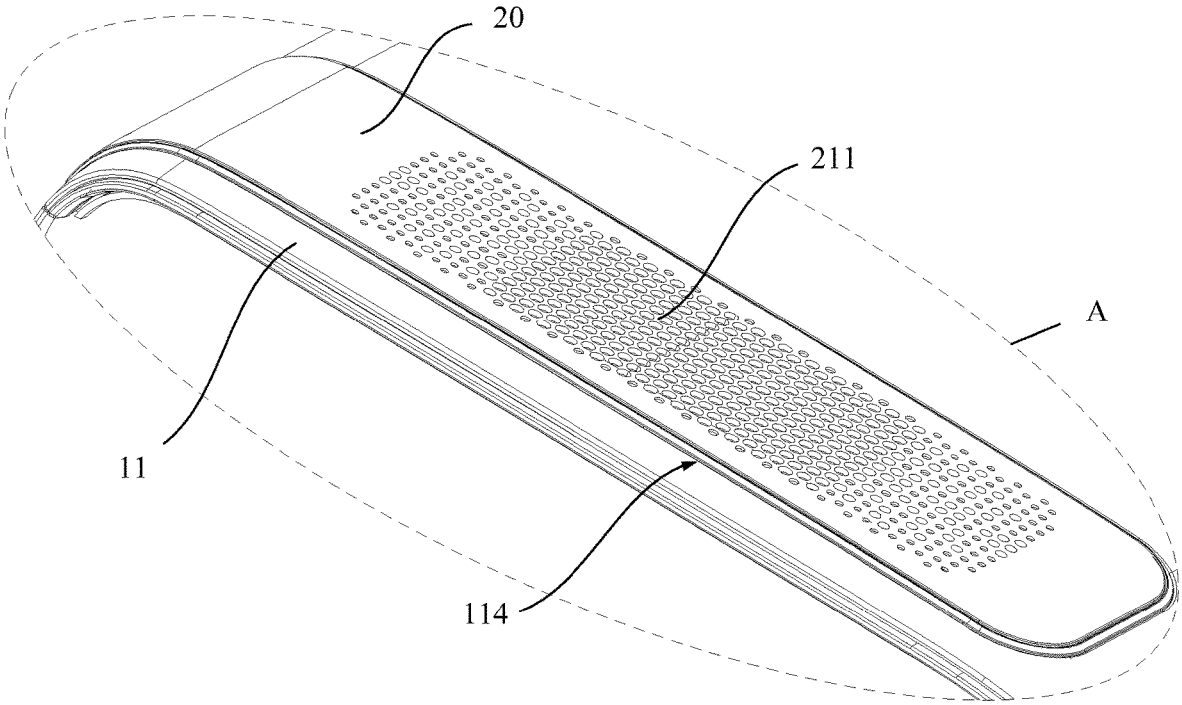
FIG. 2 is an enlarged view of portion A in FIG. 1.

In a specific embodiment, as shown in FIG. 2, the air outlet structure 211 may be an air diffusion micro hole structure, that is, the fresh air panel assembly 20 is provided with a plurality of air diffusion micro holes (the air diffusion micro holes penetrate the fresh air panel assembly 20). As such, a breezeless air supply can be realized, thereby improving the user experience. Alternatively, the air outlet structure 211 may also be an air outlet grille structure (not shown). In this way, the production difficulty and the production cost of the fresh air panel assembly 20 can be reduced while being able to generate air. Of course, the air outlet structure 211 can also be configured in other structural forms according to actual needs, and need not be described herein.

Specifically, the housing 10 includes a unit panel 11, and the fresh air outlet 111 is formed at the unit panel 11, and the fresh air panel assembly 20 is mounted at the unit panel 11.

The present disclosure further improves the structural form of the fresh air panel assembly 20 itself and its installation method. Of course, the improvement of the two aspects can also be combined with each other. Specifically, for the fresh air panel assembly 20, the fresh air panel assembly 20 can be configured as an integrated structure, and the structure is directly mounted at the housing 10. Alternatively, the fresh air panel assembly 20 includes a fresh air panel 21 and a mounting plate 22 that are separately disposed, the fresh air panel 21 is mounted at the mounting plate 22, and the mounting plate 22 and/or the fresh air panel 21 are mounted at the housing 10. For the installation manner of the fresh air panel assembly 20, the fresh air panel assembly 20 is disposed at the fresh air outlet 111 in an openable manner. Alternatively, the fresh air panel assembly 20 is non-detachably covered at the fresh air vent 111. The description will be made separately or in combination below.

It should be noted that the fresh air panel assembly 20 can be configured as a regular shape structure, such as a rectangular structure, a square structure, or a waist structure. As such, the design, fabrication, and assembly of the fresh air panel assembly 20 can be facilitated. Of course, the fresh air panel assembly 20 can also be configured as an irregular shape structure.

In order to facilitate the description of the snap structure between the fresh air panel 21 and the mounting plate 22, the following description will be made of the fresh air panel assembly 20 being a rectangular structure or a rectangular-like structure. Alternatively, the fresh air panel 21 and the mounting plate 22 hereinafter are both rectangular structures or rectangular-like structures.

The case where the fresh air panel assembly 20 includes the fresh air panel 21 and the mounting panel 22 that are separately disposed will be specifically described below.

Figure 4:
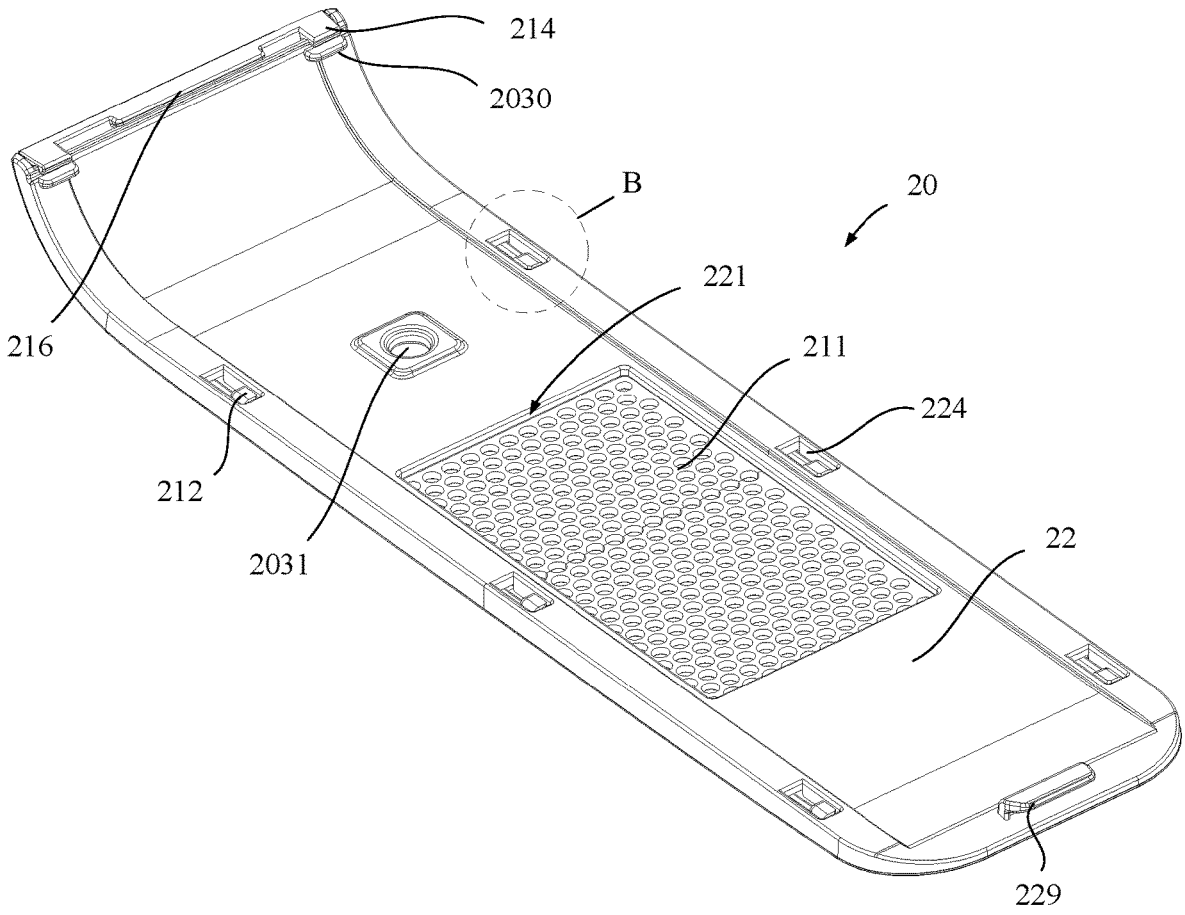
FIG. 4 is a schematic structural diagram of the fresh air panel assembly in FIG. 1.
Figure 5:
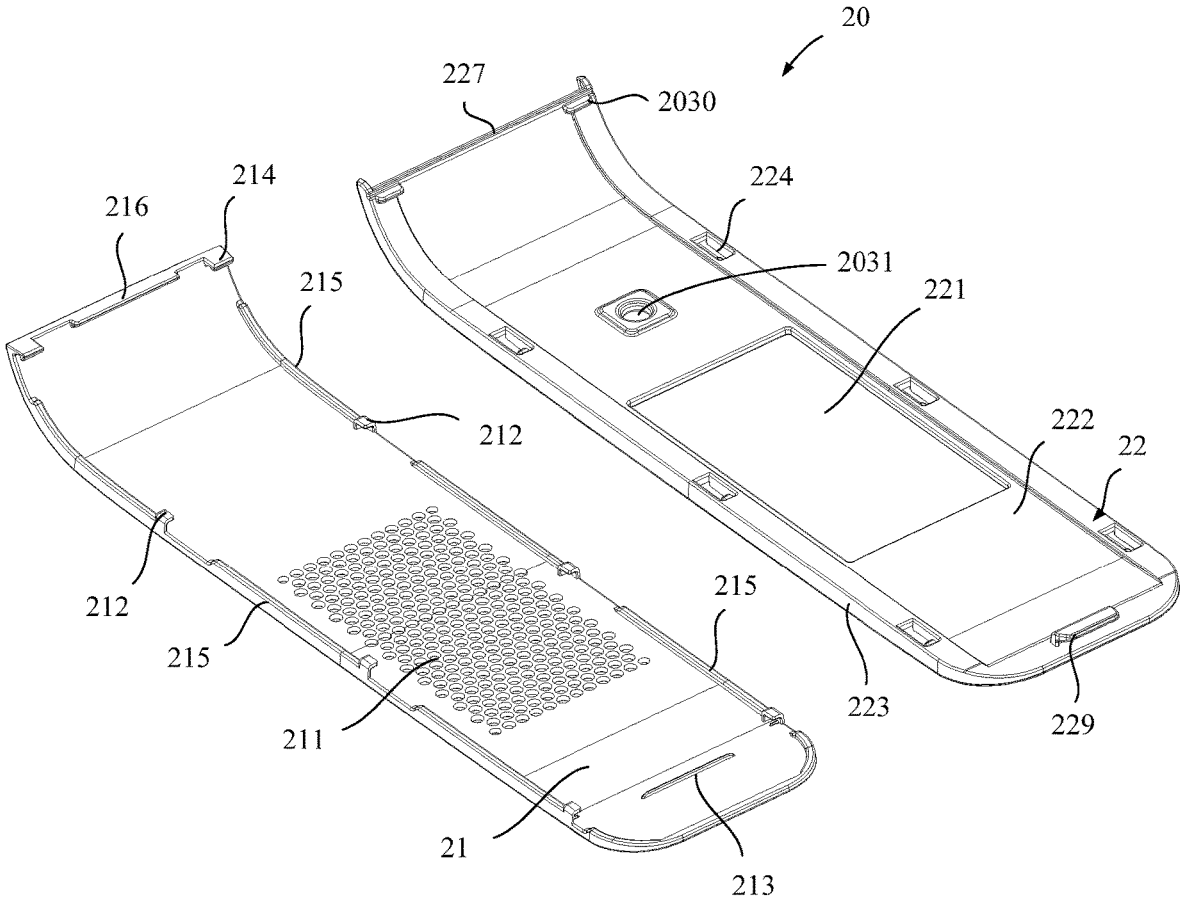
FIG. 5 is a schematic exploded view of the fresh air panel assembly in FIG. 4.

Further, as shown in FIGS. 4 and 5, the fresh air panel assembly 20 includes:

a fresh air panel 21 having an air outlet structure 211; and a mounting plate 22, the fresh air panel 21 is mounted at a surface of the mounting plate 22, the mounting plate 22 includes a vent 221 penetrating through the mounting plate 22, and the vent 221 is arranged corresponding to the air outlet structure 211. The vent 221 allows fresh air to pass through, thus avoiding the influence of the mounting plate 22 on fresh air.

During the production process, after the initial production of the fresh air panel assembly 20 (such as after demoulding), its appearance does not meet the standard and cannot be directly applied to the product. In this way, different parts of the fresh air panel assembly 20 need to be processed differently to meet the design requirements. For example, the inner and outer surfaces of the fresh air panel assembly 20 need to be sprayed, and the periphery thereof needs to be plated. However, in the present disclosure, by providing the fresh air panel 21 and the mounting plate 22 that are separately assembled, the fresh air panel 21 may be subjected to a spraying process, and the mounting plate 22 is subjected to a plating process. Optionally, a spraying process is performed on the surface of the fresh air panel 21, such as spraying an ash gold on the surface of the fresh air panel 21. A plating process is performed on the periphery of the mounting plate 22, such as plating a mocha gold on the periphery of the mounting plate 22.

It should be understood that, in the present disclosure, the fresh air panel 21 and the mounting plate 22 can be separately processed when the fresh air panel assembly 20 includes the fresh air panel 21 and the mounting panel 22 that are separately connected to each other, to simplify the processing of fresh air panel assembly 20 and improve production efficiency while meeting different design requirements.

It should be particularly noted that when the fresh air panel assembly 20 includes the fresh air panel 21 and the mounting panel 22 that are separately connected to each other, the fresh air panel assembly 20 may be disposed at the fresh air outlet 111 in an openable manner, or may be non-detachably (e.g., welded, etc.) covered at the fresh air outlet 111.

Of course, in other improvement points, the fresh air panel assembly 20 can also be provided as an integrated structure.

Further, the fresh air panel assembly 20 is fitted to the surface of the mounting panel 22 towards the surface of the mounting panel 22. As such, the gap between the fresh air panel 21 and the mounting plate 22 can be made small, even absent, so that abnormal sounds caused by air leakage can be avoided.

Further, as shown in FIGS. 3-5, the fresh air panel 21 is mounted at an outer surface of the mounting plate 22. The outer surface of the mounting plate 22 refers to the surface of the mounting plate 22 facing away from the housing 10, whereas the inner surface of the mounting plate 22 refers to the surface of the mounting plate 22 facing towards the housing 10. Similarly, the outer surface of the fresh air panel 21 refers to the surface of the fresh air panel 21 facing away from the housing 10, whereas the inner surface of the fresh air panel 21 refers to the surface of the fresh air panel 21 facing towards the housing 10.

As such, the air outlet structure may be positioned outside the vent by installing the fresh air panel on the outer surface of the mounting plate, thereby facilitating the air outlet structure to supply air to the room.

Figure 7:
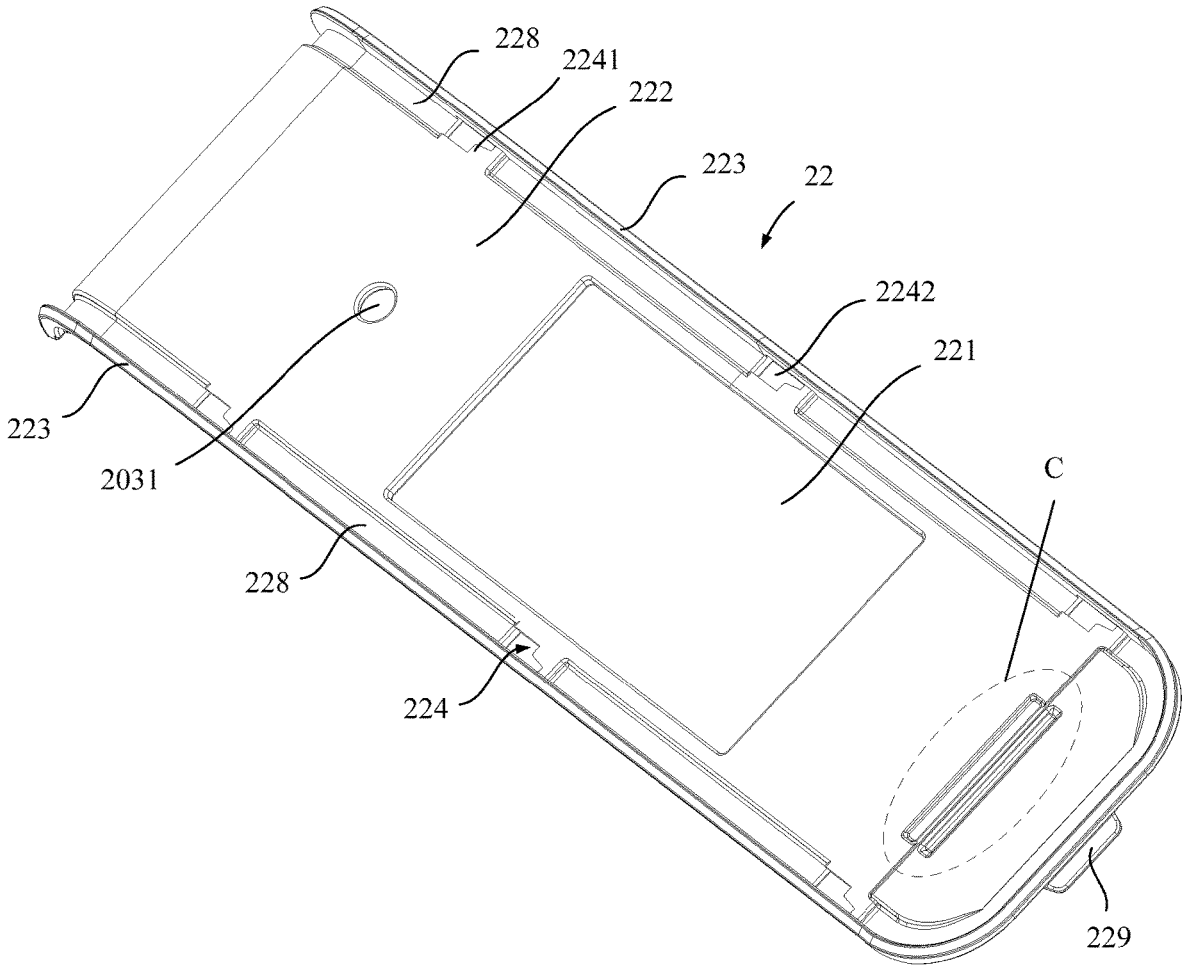
FIG. 7 is a schematic structural diagram of the mounting plate in another state in FIG. 5.

Further, as shown in FIGS. 4, 5, and 7, the mounting plate 22 includes a base plate 222 including the vent 221 and a decorative side plate 223. The decorative side plate 223 and the fresh air panel 21 are both disposed at an outer surface of the base plate 222. The fresh air panel 21 is located at an inner side of the decorative side plate 223. The inner side of the decorative side plate 223 refers to the side of the decorative side plate 223 towards the center of the base plate 222.

As such, when the mounting plate 22 includes a base plate 222 and a decorative side plate 223 both disposed at an outer surface of the base plate 222, a mounting space may be formed between the base plate 222 and the decorative side plate 223. When the fresh air panel 21 is mounted at the outer surface of the base plate 222 and on the inner side of the decorative side plate 223, the fresh air plate 21 is installed in the mounting space so that the fresh air panel 21 can be shielded.

Specifically, the decorative side plate 223 is disposed at an edge of the base plate 222. As such, it is convenient to reduce the size of the mounting plate 22.

Specifically, the side edge of the fresh air panel 21 is disposed near the decorative side plate 223. In this way, the compactness of the assembly between the fresh air panel 21 and the mounting plate 22 can be improved, and the design rationality can be improved, that is, the miniaturization and rational design of the fresh air panel assembly 20 can be realized.

Specifically, the decorative side plate 223 can be subjected to a plating process. Thus, by providing the decorative side plate 223, the peripheral edge of the mounting plate 22 can be easily plated, and the plating effect can be easily exhibited.

Further, as shown in FIG. 5, the fresh air panel 21 is connected to the mounting plate 22 through a snap structure. Generally, the snap structure is easy to process and does not damage the structure of the fresh air panel assembly 20 itself. Moreover, by designing the snap structure, the snap structures are mutually coupled, and the desired connection effect can be easily achieved. Moreover, the assembly of the snap structure is simple, convenient, and secure.

The following describes the snap structure between the fresh air panel 21 and the mounting plate 22 in detail; it can be understood that the snap structure between the fresh air panel 21 and the mounting panel 22 is not limited thereto.

Figure 6:
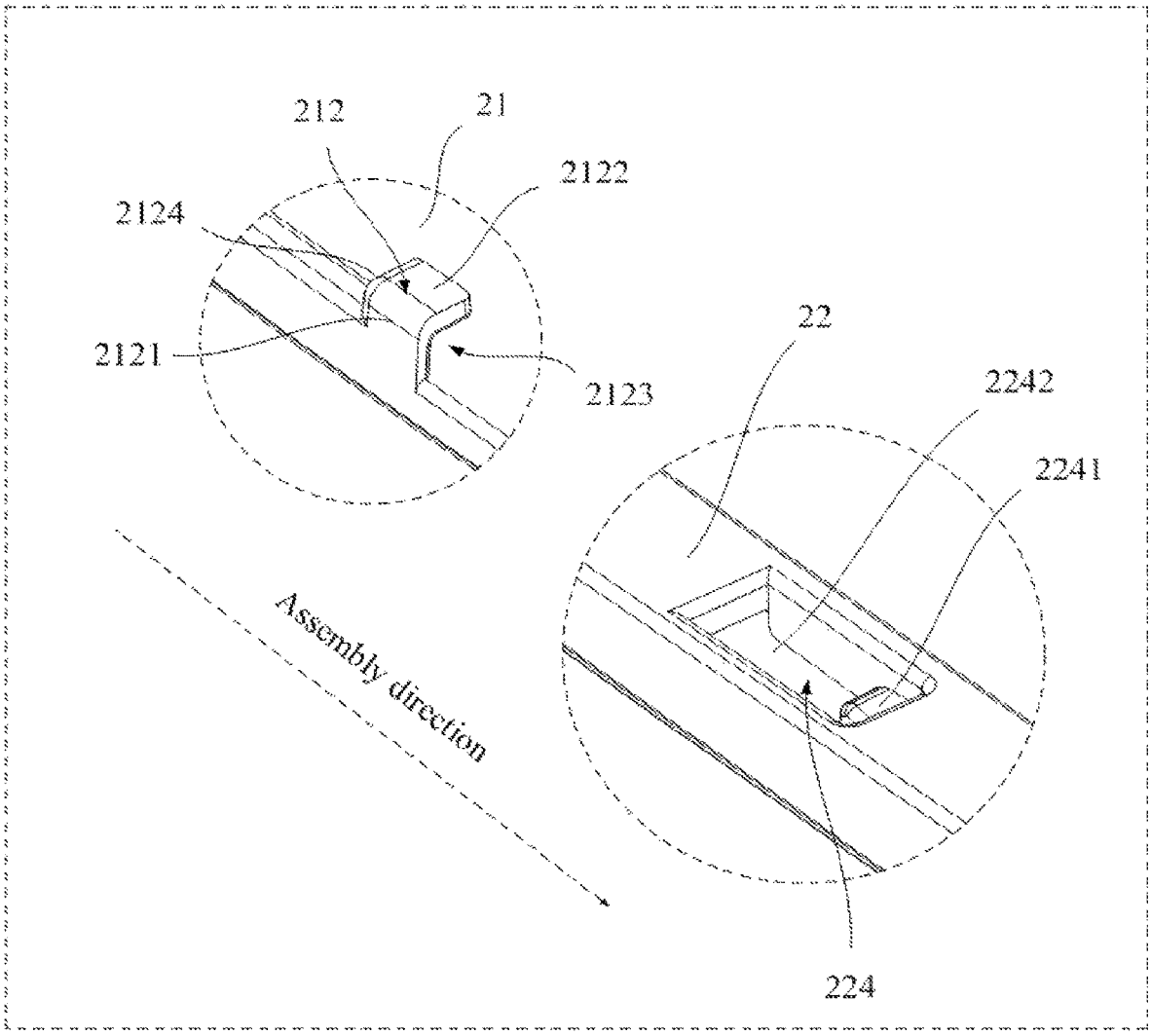
FIG. 6 is an enlarged view of the assembly process of the latch protrusion and the clamp hole at portion B in FIG. 4.

The snap structure includes a clamp structure. Specifically, as shown in FIGS. 4-6, the inner side surface of the fresh air panel 21 is provided with a clamp protrusion 212. The mounting plate 22 is provided with a clamp hole 224, and the clamp protrusion 212 is inserted in the clamp hole 224. Thus, the initial installation positioning of the fresh air panel 21 and the mounting plate 22 can be achieved by the cooperation of the clamp protrusion 212 and the clamp hole 224.

Further, as shown in FIG. 5 and FIG. 6, the clamp protrusion 212 includes a connection protrusion 2121 protruding from an inner surface of the fresh air panel 21, and a limit protrusion 2122 laterally protruding from the connection protrusion 2121, and facing the fresh air panel 21. The connection protrusion 2121, the limit protrusion 2122 and the fresh air panel 21 cooperatively form a clamp groove 2123.

Figure 9:
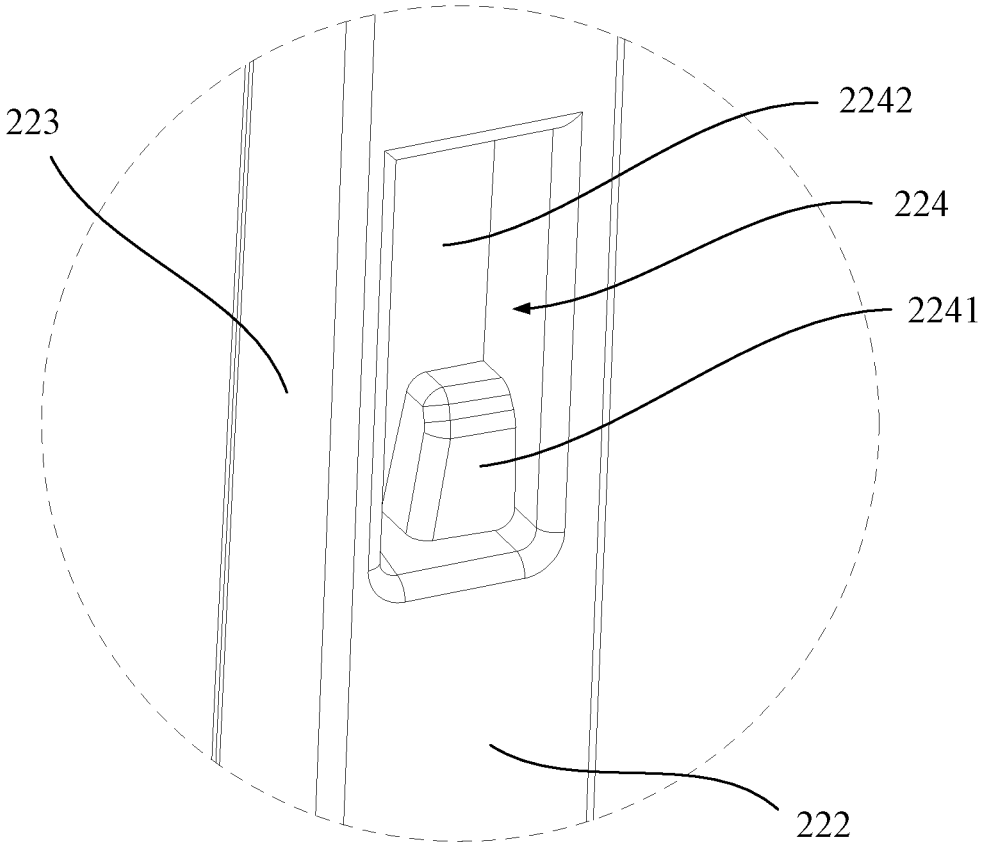
FIG. 9 is an enlarged view of hole in FIG. 7.
Figure 10:
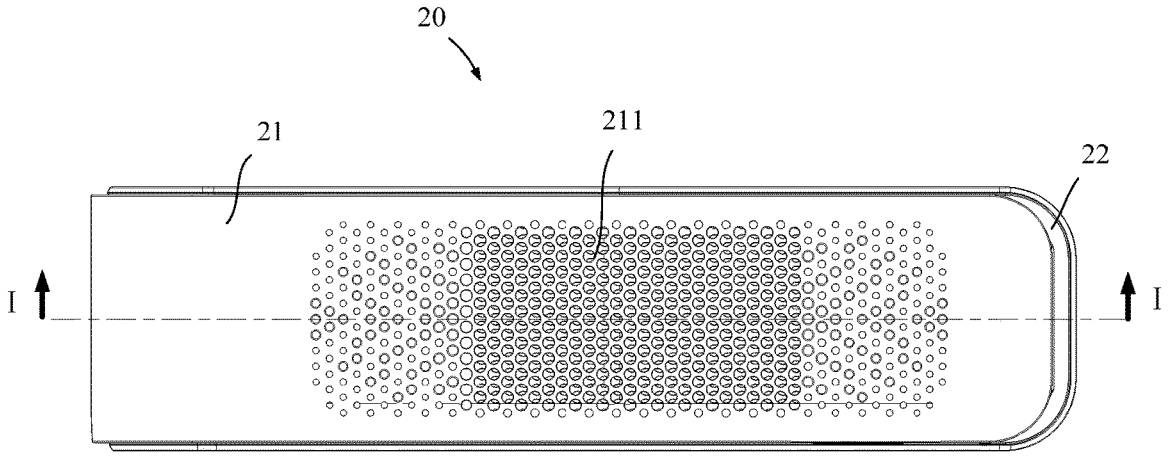
FIG. 10 is a top view of the fresh air panel assembly in FIG. 4; the fresh air panel and the mounting plate are in an incompletely assembled state.
Figure 11:
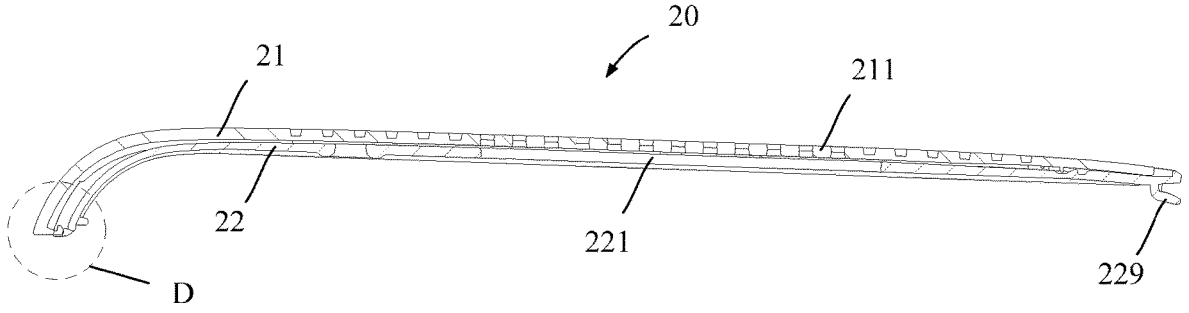
FIG. 11 is a cross-sectional view of the fresh air panel assembly taken along line I-I in FIG. 10.
Figure 12:
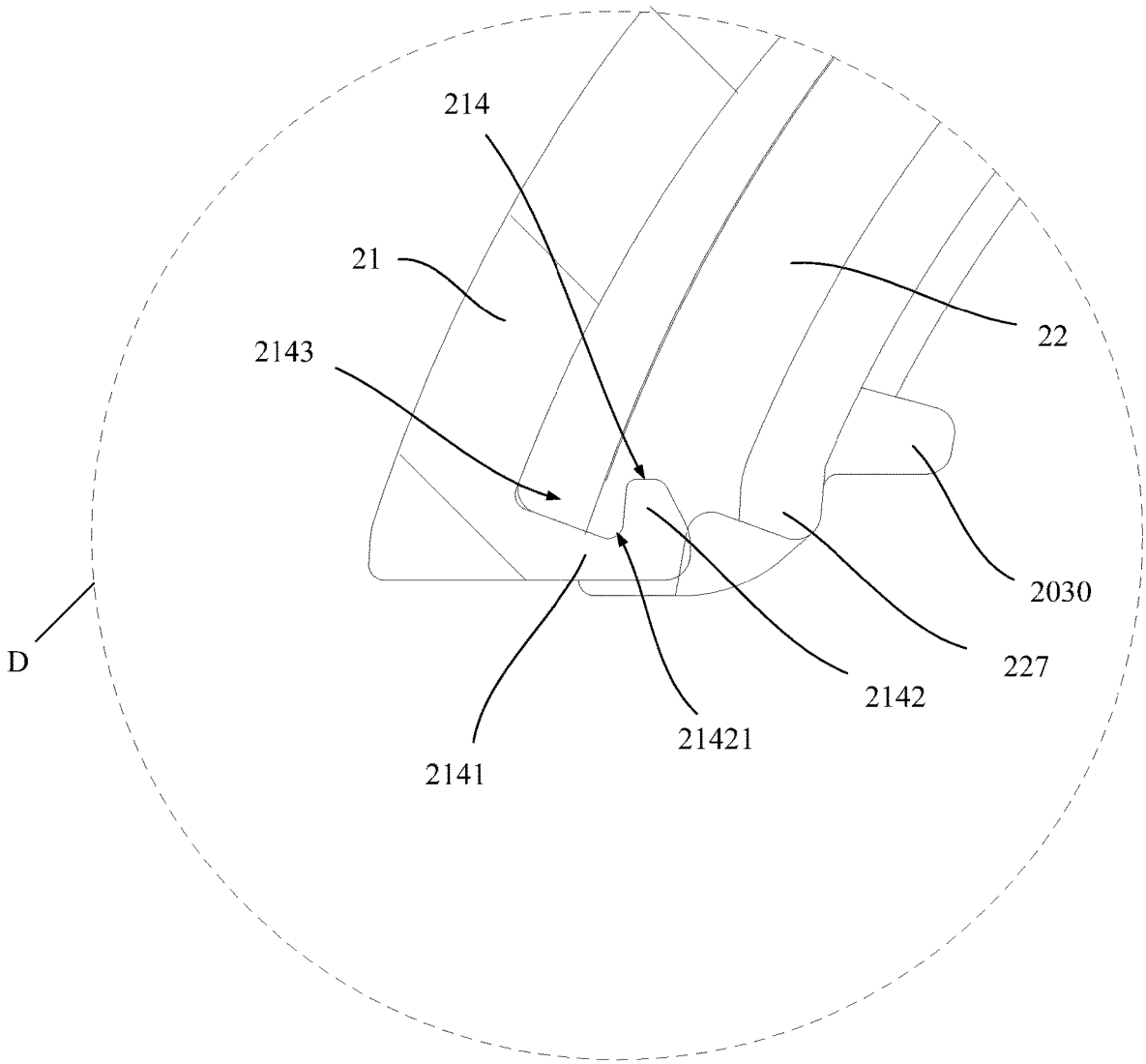
FIG. 12 is an enlarged view of portion D in FIG. 11.

As shown in FIGS. 5, 6 and 9, a latch protrusion 2241 is protruded from an inner side wall of the clamp hole 224, a mounting gap 2242 is formed between the latch protrusion 2241 and the inner side wall of the clamp hole 224, and the latch protrusion 2241 is clamped in the clamp groove 2123. The mounting gap 2242 is configured to pass the clamp protrusion 212.

Specifically, the clamp groove 2123 includes an inlet; as shown in FIG. 6, when mounting the fresh air panel 21 and the mounting plate 22, first inserting the clamp protrusion 212 into the mounting gap of the clamp hole 224, and then driving the fresh air panel 21 and the mounting plate 22 to move relative to each other, so that the latch protrusion 2241 is moved into the clamp groove 2123 through the entrance of the clamp groove 2123. At this time, the limit protrusion 2122 restricts the movement of the latch protrusion 2241, so that the fresh air panel 21 and the mounting plate 22 can be clamped.

As such, the fresh air panel 21 and the mounting plate 22 can be connected simply and conveniently through the above structural arrangement.

Further, as shown in FIG. 6, the clamp protrusion 212 further includes a reinforcement protrusion 2124 protruding from an inner surface of the fresh air panel 21, and connecting to the limit protrusion 2122 and the fresh air panel 21. The structural strength of the clamp protrusion 212 can be enhanced by providing the reinforcement protrusion 2124, so that the connection strength and stability of the fresh air panel 21 and the mounting plate 22 can be increased.

Further, as shown in FIGS. 5 and 6, the reinforcement protrusion 2124 is disposed in an extension direction of the latch protrusion 2241. The reinforcement protrusion 2124 can also position the latch protrusion 2241.

Further, as shown in FIGS. 5 and 6, the clamp protrusion 212 is one of a plurality of clamp protrusions 212, and the clamp hole 24 corresponding to the clamp protrusion 212 is one of a plurality of clamp holes 224. Each clamp protrusion 212 is inserted in the corresponding clamp hole 224. In this way, the connection strength and stability of the fresh air panel 21 and the mounting plate 22 can be further enhanced.

Further, the clamp protrusion 212 may be regularly distributed; thus, the design and fabrication of the fresh air panel 21 may be facilitated.

Further, as shown in FIGS. 5 and 6, the clamp protrusions 212 are provided in two rows. It can be understood that the greater the number of the clamp protrusions 212, the more difficult the production of the fresh air panel 21. Therefore, by providing two rows of the clamp protrusions 212, the connection strength and stability of the fresh air panel 21 and the mounting plate 22 can be ensured, and the waste and the difficulty in manufacturing can also be avoided. Of course, the clamp protrusion 212 can also be designed to have other regular distributions.

Further, the two rows of clamp protrusions 212 are disposed at opposite sides of the fresh air panel 21 respectively. In this way, the clamp protrusion 212 can be prevented from interfering with other structures such as the air outlet structure 211, thereby facilitating the miniaturization design of the fresh air panel 21.

Specifically, two rows of clamp protrusions 212 are disposed at the two long sides of the fresh air panel 21 respectively. The corresponding holes 224 are also provided in two rows, and are disposed at the two long sides of the mounting plate 22 respectively. By providing the latching structure of the clamp protrusion 212 and the clamp hole 224 on the long side of the fresh air panel assembly 20, the connection strength and stability of the long side of the fresh air panel 21 and the long side of the mounting plate 22 can be easily improved, further, it is advantageous to improve the connection strength and stability of the fresh air panel 21 and the mounting plate 22.

It can be understood that the orientations of the entrances of the clamp groove 2123 formed by the plurality of protrusions 212 should be consistent to ensure uniformity of assembly, thereby simplifying the assembly process.

Further, the latch protrusion 2241 is extended along a length direction of the fresh air panel assembly 20. As such, driving the fresh air panel 21 and the mounting plate 22 to move relative to each other along a length direction of the fresh air panel assembly 20, so that the latch protrusion 2241 can be moved into the clamp groove 2123 via the entrance of the clamp groove 2123. Of course, the latch protrusion 2241 can also be extended in other direction.

Further, as shown in FIGS. 5-8 and 11-16, one of an inner side surface of the fresh air panel 21 and an outer surface of the mounting plate 22 is provided with an anti-falling protrusion 213, while the other one is provided with an anti-falling groove 225, and the anti-falling protrusion 213 is inserted in the anti-falling groove 225. By providing the anti-falling protrusion 213 and the anti-falling groove 225 that cooperate with each other, the fresh air panel 21 and the mounting plate 22 can be prevented from moving in the opposite direction, thereby preventing the clamp protrusion 212 from detaching from the clamp hole 224.

It should be understood that in a specific embodiment, the thickness of the fresh air panel 21 and the mounting plate 22 are both thin, and the structural strength of the components such as the snap structure is also weak, if it is repeatedly removed, it is easily damaged. Therefore, if the snap structure between the fresh air panel 21 and the mounting plate 22 is designed as a detachable structure, it is easy for the user to damage the fresh air panel assembly 20 during the disassembly process. However, in the present disclosure, by providing the anti-falling protrusion 213 in combination with the anti-falling groove 225, the snap structure between the fresh air panel 21 and the mounting plate 22 can be made into a detachable or non-removable structure, thereby reducing the risk of damage of the fresh air panel assembly 20. Moreover, it can prevent mis-disassembly (i.e.: when the fresh air panel assembly 20 needs to be detached from the housing 10, the fresh air panel 21 or the mounting plate 22 is mistakenly removed).

Specifically, as shown in FIG. 5, the anti-falling protrusion 213 is disposed at the inner side surface of the fresh air panel 21, and the anti-falling groove 225 is disposed in the outer surface of the mounting plate 22.

Further, as shown in FIGS. 7, 8, and 11-16, the outer surface of the mounting plate 22 is further provided with an alignment groove 226 near the anti-falling groove 225. The alignment groove 226 is configured to guide the anti-falling protrusion 213 to slide into the anti-falling groove 225. In this way, the difficulty of installation between the fresh air panel 21 and the mounting plate 22 can be reduced.

It can be understood that since the fresh air panel 21 and the mounting plate 22 are installed in a sliding fit, when initially positioned (i.e., when the clamp protrusion 212 protrudes into the mounting gap of the clamp hole 224), there is a misalignment between the anti-falling protrusion 213 and the anti-falling groove. If the alignment groove 226 is not provided, the anti-falling protrusion 213 directly abuts against the outer surface of the mounting plate 22, thereby increasing the difficulty of installation between the fresh air panel 21 and the mounting plate 22.

In the present disclosure, by providing the alignment groove 226, when initially positioned (i.e., when the clamp protrusion 212 protrudes into the mounting gap of the clamp hole 224), the anti-falling protrusion 213 is inserted in the alignment protrusion, so that the fresh air panel 21 and the mounting plate 22 can be easily aligned, thereby reducing the difficulty of installation between the fresh air panel 21 and the mounting plate 22. Then, when the fresh air panel 21 and the mounting plate 22 move relative to each other, the anti-falling protrusion 213 slides from the alignment groove 226 to the anti-falling groove 225, thereby completing the mounting between the fresh air panel 21 and the mounting plate 22.

In a specific embodiment, further improvement can be made on the alignment groove 226 and/or the anti-falling protrusion 213 to facilitate guiding the anti-falling protrusion 213 to slide from the alignment groove 226 to the anti-falling groove 225, which will be specifically described below.

Specifically, as shown in FIGS. 7, 8, and 11-16, the alignment groove 226 has a guiding inner side wall 2261 near the anti-falling groove 225, and at least a part of the guiding inner wall surface 2261 is inclined towards a direction near the anti-falling groove 225. As such, the anti-falling protrusion 213 can be easily guided to slide from the alignment groove 226 to the anti-falling groove 225.

Optionally, the guiding inner wall surface 2261 is inclined towards the anti-falling groove 225. As such, the guiding effect can be enhanced.

Specifically, when the anti-falling protrusion 213 is disposed into the anti-falling groove 225, the anti-falling protrusion 213 has a guiding outer side wall (not shown) away from the alignment groove 226. At least a part of the guiding outer side wall is inclined towards the alignment groove 226. As such, the anti-falling protrusion 213 can be easily guided to slide from the alignment groove 226 to the anti-falling groove 225.

Optionally, the guiding outer side wall is inclined towards the alignment groove 226. As such, the guiding effect can be enhanced.

Specifically, a depth of the alignment groove 226 is less than a depth of the anti-falling groove 225. As such, the anti-falling protrusion 213 can be further easily guided to slide from the alignment groove 226 to the anti-falling groove 225.

Figure 8:
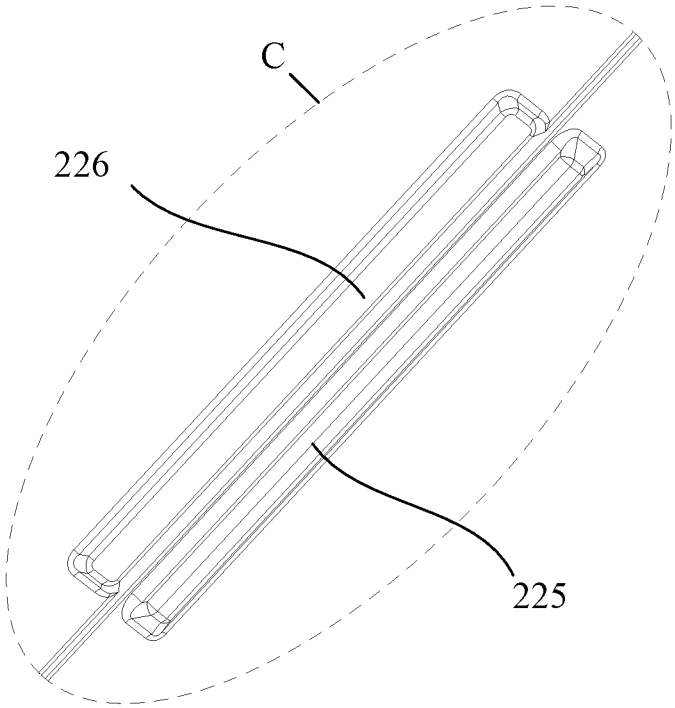
FIG. 8 is an enlarged view of portion C in FIG. 7.

Further, as shown in FIGS. 5 and 8, the anti-falling protrusion 213 is strip shaped, and the anti-falling groove 225 is arranged corresponding to the alignment groove 226. In this way, the structural strength of the anti-falling protrusion 213 can be enhanced, so that the connection strength between the fresh air panel 21 and the mounting plate 22 can be enhanced.

Specifically, the extension direction of the anti-falling protrusion 213 and the relative movement direction of the fresh air panel 21 and the mounting plate 22 form an angle. The angle is usually set to 90 degrees, or close to 90 degrees. In this way, the relative movement distance of the fresh air panel 21 and the mounting panel 22 when installed can be reduced, thereby not only simplifying the assembly process, but also achieving a compact design.

Optionally, the anti-falling protrusion 213 is extended along a width direction of the fresh air panel assembly 20.

Further, as shown in FIGS. 4, 5 and 10-16, the inner side surface of the fresh air panel 21 is provided with a hook 214. The hook 214 includes a support protrusion 2141 protruding from the inner side surface of the fresh air panel 21, and a blocking protrusion 2142 laterally protruding from the support protrusion 2141. The support protrusion 2141, the blocking protrusion 2142 and the fresh air panel 21 cooperatively form a hook groove 2143, and one side of the mounting plate 22 is clamped in the hook 214 groove. In this way, one side of the mounting plate 22 can be restrained in the hook 214 groove, so that the connection strength and stability of the fresh air panel 21 and the mounting plate 22 can be improved.

Specifically, the hook 214 is disposed near the edge of the fresh air panel 21; thus, it is advantageous to realize a compact design.

Further, as shown in FIGS. 11, 12, 15 and 16, a side surface of the blocking protrusion 2142 facing towards the inner side surface of the fresh air panel 21 is provided with an anti-disengagement groove 21421, a side of the mounting plate 22 is provided with an anti-disengagement protrusion 227, and the anti-disengagement protrusion 227 is fitted in the anti-disengagement groove 21421. In this way, one side of the mounting plate 22 can be prevented from coming off the hook groove 2143, so that the connection strength between one side of the mounting plate 22 and the hook groove 2143 can be enhanced.

Further, as shown in FIGS. 4 and 5, the hook is one of a plurality of the hooks 214 and the hooks 214 are provided at the side of the mounting plate 22 in an extension direction of the mounting plate 22. In this way, the connection strength and stability of the fresh air panel 21 and the mounting plate 22 can be further enhanced.

Optionally, the hook 214 is disposed at a short side of the fresh air panel 21. As such, the latching structure of the hook 214 and the one side of the mounting plate 22 can be better matched with the latching structure of the clamp protrusion 212 and the clamp hole 224. Therefore, the connection of the fresh air panel 21 and the mounting plate 22 is realized in a multi-point/multi-directional manner, so that the connection strength and stability of the fresh air panel 21 and the mounting plate 22 can be improved.

Further, the inner side surface of the fresh air panel 21 is further provided with an abutting protrusion 216 near the clamp protrusion 212, and one side of the mounting plate 22 abuts against the abutting protrusion 216. Specifically, the abutting protrusion 216 is disposed at a short side of the fresh air panel 21.

Specifically, as shown in FIGS. 4 and 5, the anti-falling protrusion 213 is disposed near the other short side of the fresh air panel 21.

Further, as shown in FIGS. 5 and 7, one of the fresh air panel 21 and the mounting plate 22 is provided with a reinforcement rib 215, while the other one is provided with a reinforcement groove 228. The reinforcement rib 215 is disposed in the reinforcement groove 228. In this way, the structural strength of the fresh air panel 21 and the mounting panel 22 can be separately enhanced, and the risk of damage can be reduced.

Specifically, as shown in FIGS. 5 and 7, the reinforcement rib 215 is disposed at the inner surface of the fresh air panel 21, and the reinforcement groove 228 is disposed at the outer surface of the mounting plate 22.

Specifically, as shown in FIGS. 5 and 7, the mounting plate 22 is laterally recessed to form a reinforcement groove 228.

Specifically, as shown in FIGS. 5 and 7, the reinforcement rib 215 may extend along the length direction of the fresh air panel 21; the reinforcement groove 228 may extend along the length direction of the mounting plate 22. Optionally, a plurality of the reinforcement ribs 215 are provided at intervals along the length direction of the fresh air panel 21; a plurality of the reinforcement grooves 228 are provided at intervals along the length direction of the mounting plate 22. In this way, the structural strength of the fresh air panel 21 and the mounting plate 22 can be further enhanced. Optionally, the reinforcement rib 215 is disposed near the long side of the fresh air panel 21, and the reinforcement groove 228 is disposed near the long side of the mounting plate 22.

It should be particularly noted that, through the above structural arrangement, the connection between the fresh air panel 21 and the mounting plate 22 becomes difficult to remove or undetachable, thereby reducing the risk of the user damaging the fresh air panel assembly 20. Moreover, it can prevent mis-disassembly.

Further, as shown in FIGS. 4 and 5, the fresh air panel assembly 20 is a bending member; the fresh air panel 21 is a bending member, and the mounting plate 22 is a bending member. As such, the shape of the fresh air panel assembly 20 can be matched with the shape of the air conditioner indoor unit 100. Further, the fresh air panel assembly 20 is provided as a bending member, which also enhances the connection strength between the fresh air panel assembly 20 and the housing 10.

Of course, when the length of the fresh air panel assembly 20 is short, it can also be set to be non-bending, that is, or substantially flat.

The case where the fresh air panel assembly 20 may be disposed at the fresh air outlet 111 in an openable manner will be specifically described below.

Further, as shown in FIGS. 17, 18, 20, and 21, the fresh air panel assembly 20 may be disposed at the fresh air outlet 111 in an openable manner.

Specifically, the fresh air panel assembly 20 has at least a blowing state of covering the fresh air vent 111 and a cleaning state of opening the fresh air vent 111. In the blowing state, the air outlet structure 211 corresponds to the fresh air vent 111 to supply air to the room. In the cleaning state, the fresh air panel assembly 20 and/or the fresh air vent 111 may be cleaned.

As such, in the present disclosure, the fresh air panel assembly 20 is disposed at the fresh air outlet 111 in an openable manner, the fresh air panel assembly 20 is opened to perform cleaning processing on the fresh air panel assembly 20, thereby simplifying the cleaning process of the fresh air panel assembly 20 and improving cleaning efficiency.

It should be particularly noted that when the fresh air panel assembly 20 is disposed at the fresh air outlet 111 in an openable manner, the fresh air panel assembly 20 may be an integrated structure or may include the fresh air panel 21 and the mounting plate 22 that are separately disposed.

In a specific embodiment, there are many structural forms for realizing that the "the fresh air panel assembly 20 is disposed at the fresh air outlet 111 in an openable manner," and the following examples are explained. However, it should be noted that those skilled in the art will readily appreciate further implementations in light of the present disclosure.

Further, as shown in FIGS. 17, 18, 20, and 21, the fresh air panel assembly 20 is detachably connected to the housing 10 such that the fresh air panel assembly 20 is disposed at the fresh air outlet 111 in an openable manner. Specifically, the fresh air panel assembly 20 is detachably connected to the unit panel 11.

As such, the fresh air panel assembly 20 is detachably connected to the housing 10, upon cleaning, the fresh air panel assembly 20 can be removed from the housing 10 to detach the fresh air panel assembly 20 from the housing 10. Therefore, not only the cleaning of the fresh air panel assembly 20 is not limited by the position, thereby improving the convenience and safety for the user to clean the fresh air panel assembly 20, but also it is possible to prevent the fresh air panel assembly 20 from interfering with the cleaning at the fresh air vent 111, thereby improving the convenience of cleaning at the fresh air vent 111.

In a specific embodiment, the structure for realizing the detachable connection between the fresh air panel assembly 20 and the housing 10 may include one or more of a screw structure, a snap structure, a magnetic structure, and the like. The detachable connection between the fresh air panel assembly 20 and the housing 10 is realized by the snap structure, so that the connection between the fresh air panel assembly 20 and the housing 10 can be made simple and convenient.

In the air conditioner indoor unit 100 according to a first embodiment of the present disclosure, the fresh air panel assembly 20 is connected to the housing 10 through the snap structure, the details are described below.

Figure 17:
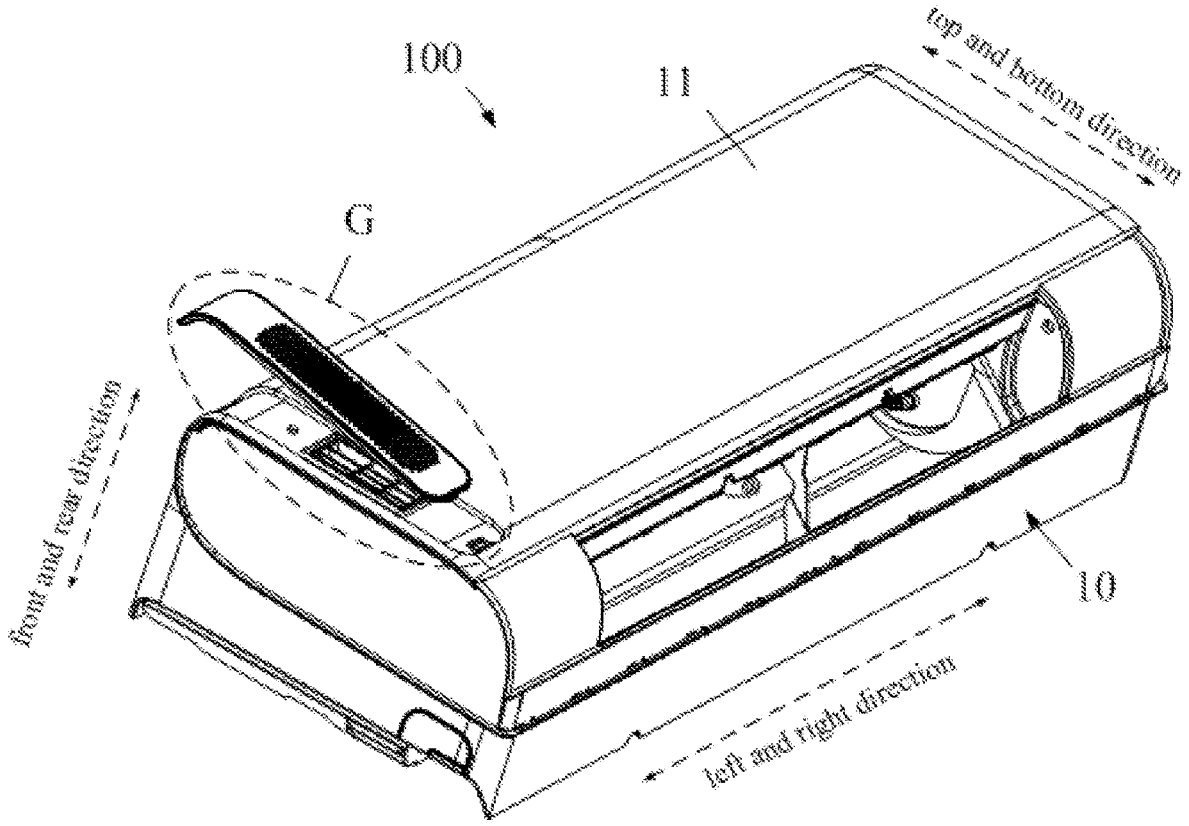
FIG. 17 is a schematic structural diagram of the air conditioner indoor unit according to a first embodiment of the present disclosure.
Figure 18:
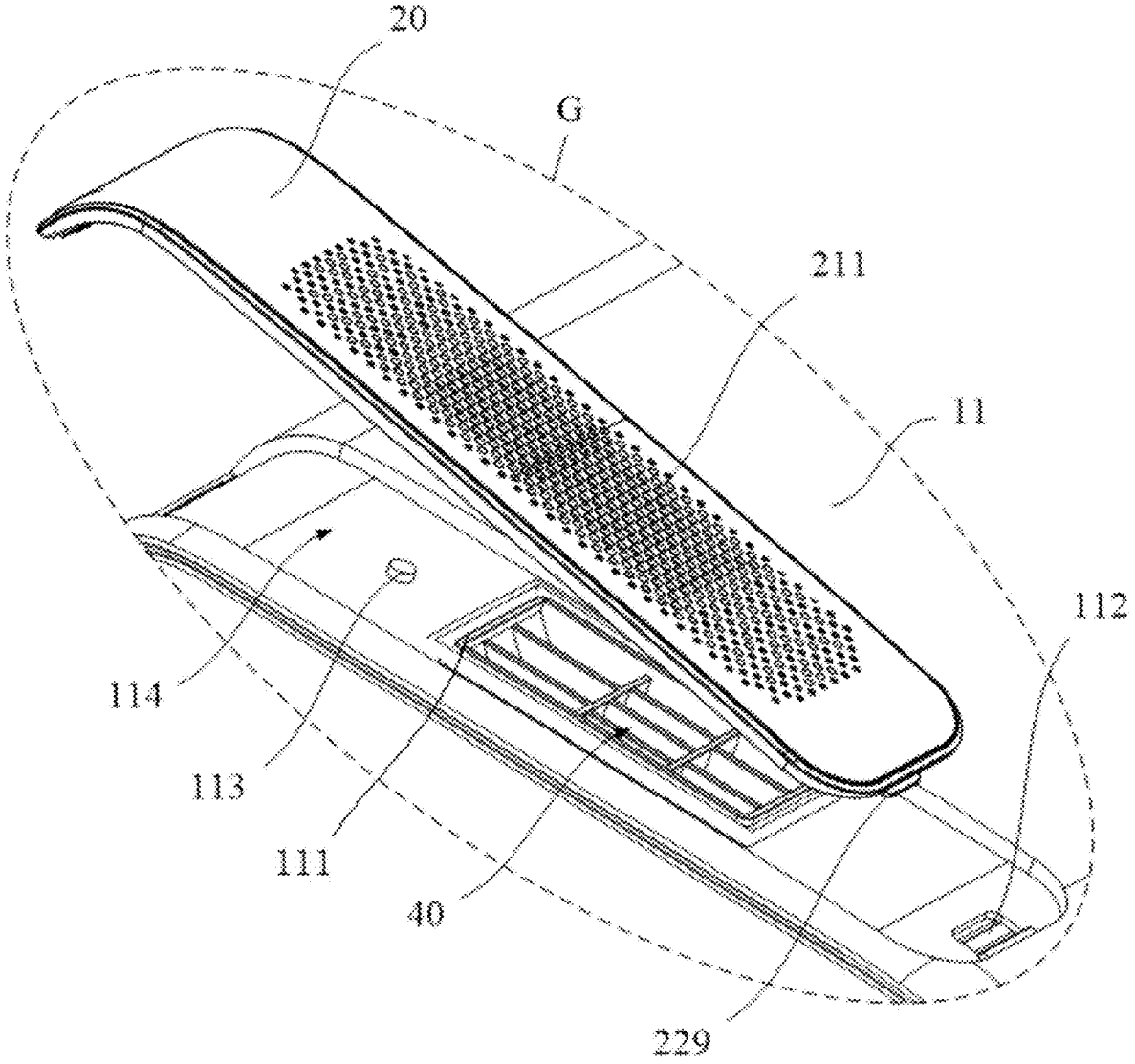
FIG. 18 is an enlarged view of portion Gin FIG. 17.
Figure 19:
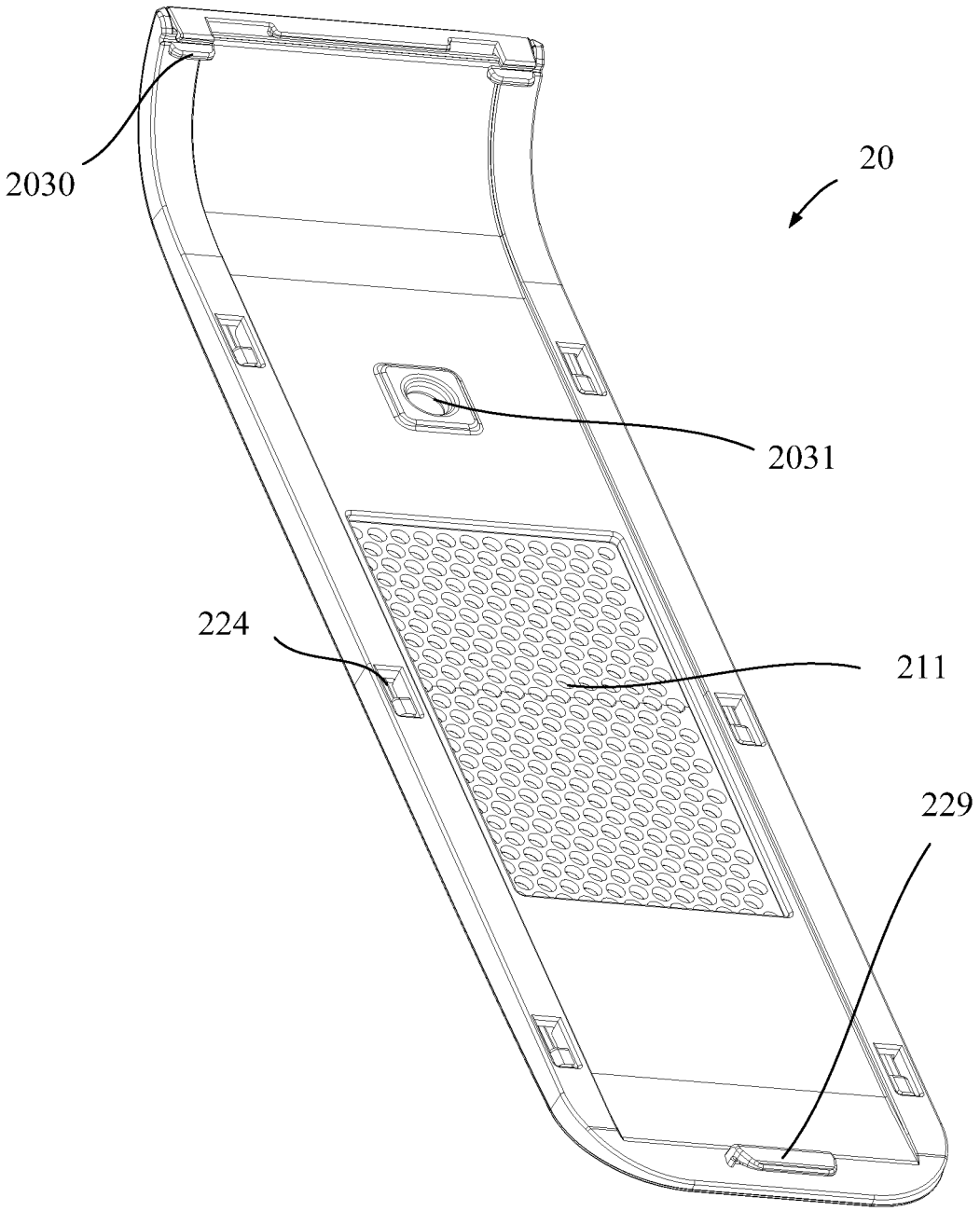
FIG. 19 is a schematic structural diagram of the fresh air panel assembly in FIG. 17.

Further, as shown in FIGS. 17-19, one end of the fresh air panel assembly 20 is connected to the housing 10 through the snap structure. Specifically, one end of the fresh air panel assembly 20 is connected to the unit panel 11 through the snap structure. As such, one end of the fresh air panel assembly 20 can be connected to the housing 10.

Further, as shown in FIGS. 18 and 19, one end of the fresh air panel assembly 20 is provided with a tongue 229, and the housing 10 is provided with a slot 112, and the tongue 229 is inserted in the slot 112. The slot 112 is disposed at the unit panel 11. Thus, one end of the fresh air panel assembly 20 can be connected to the housing 10 by providing a simple tongue 229 and a slot 112 structure. Thereby, the structure of the fresh air panel assembly 20 is simple, and the connection between the fresh air panel assembly 20 and the housing 10 is simple and convenient.

Specifically, when the fresh air panel assembly 20 includes the fresh air panel 21 and the mounting plate 22, the tongue is optionally disposed at the mounting plate 22.

Figure 13:
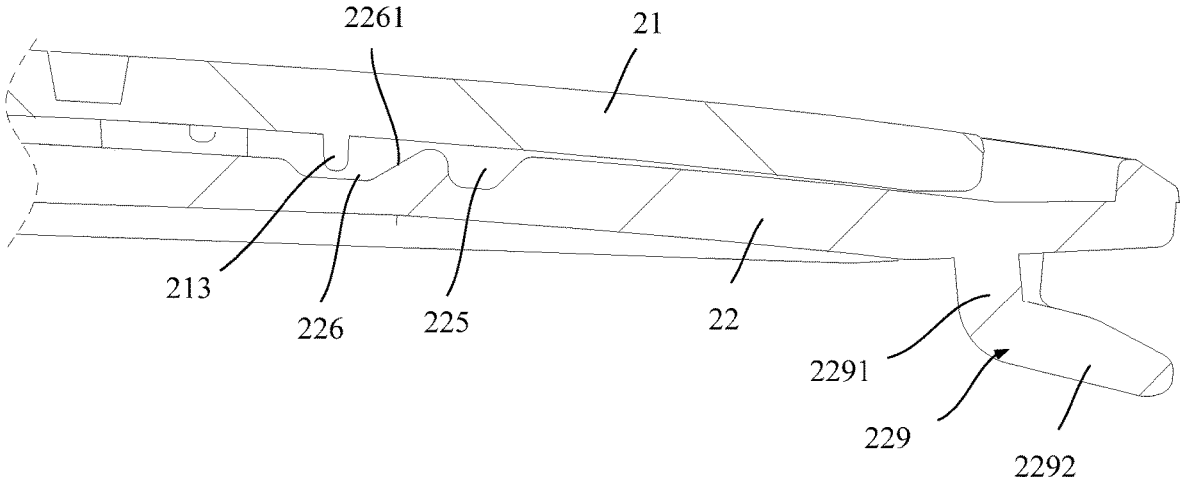
FIG. 13 is a partial enlarged view of the right end in FIG. 11.
Figure 14:
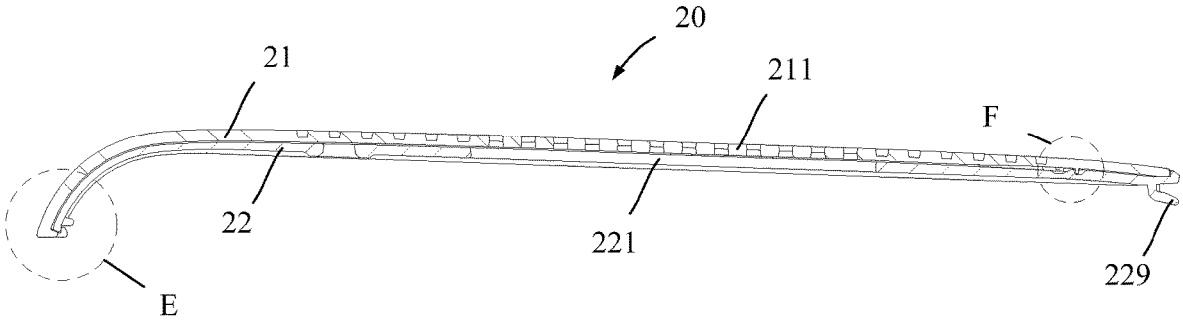
FIG. 14 is a cross-sectional view of the fresh air panel assembly in another state; the fresh air panel and the mounting plate are in a fully assembled state.
Figure 15:
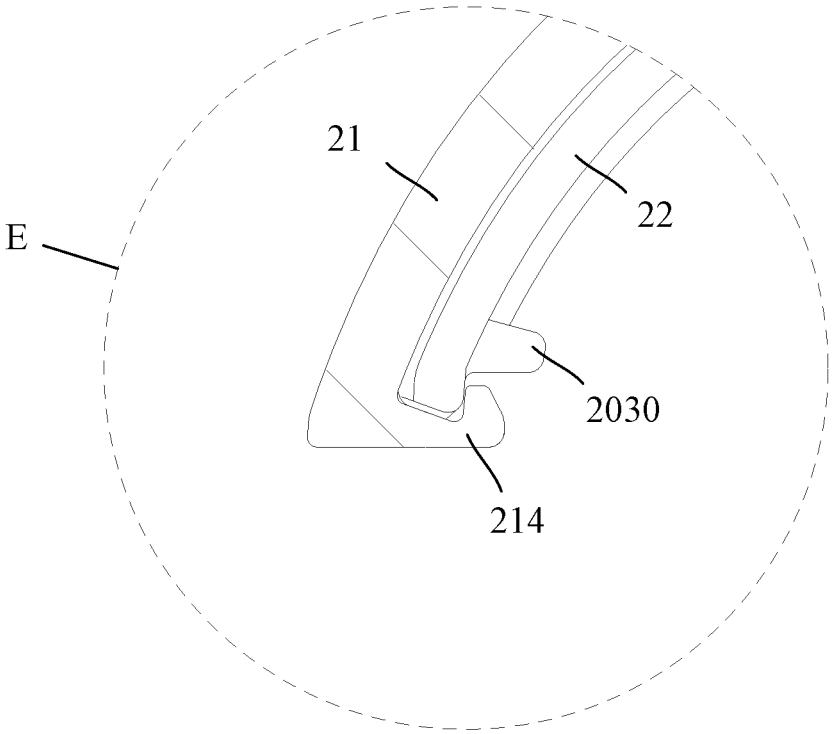
FIG. 15 is an enlarged view of portion E in FIG. 14.
Figure 16:
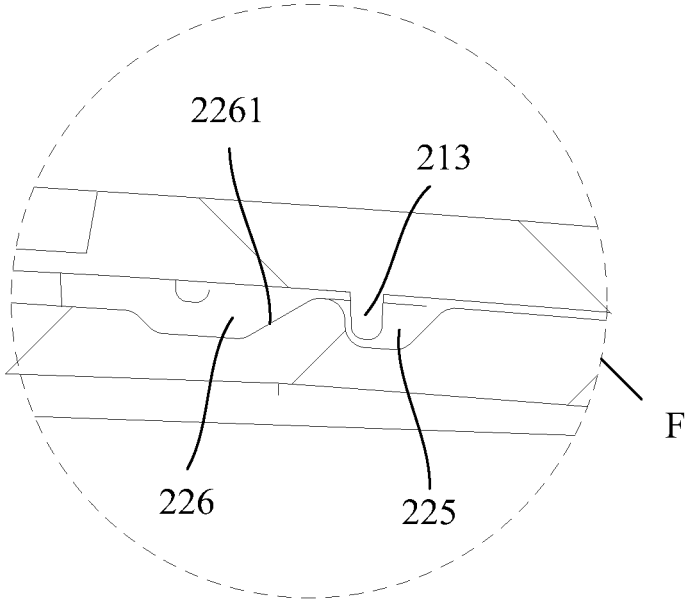
FIG. 16 is an enlarged view of portion F in FIG. 14.

Further, as shown in FIGS. 13, 18 and 19, the tongue 229 is disposed at an inner surface of the fresh air panel assembly 20. The tongue 229 includes a tongue root member 2291 protruding from an inner surface of the fresh air panel assembly 20 and a insertion member 2292 protruding laterally from the tongue root member 2291. The insertion member 2292 extends away from the other end of the fresh air panel assembly 20. The slot periphery of the slot 112 is interposed between the insertion member 2292 and the fresh air panel 21. Specifically, the tongue 229 is disposed at the inner surface of the mounting plate 22.

It can be understood that the shell wall of the housing 10 (i.e., the unit panel 11) has a certain thickness. When the thickness of the shell wall where the slot 112 is formed is thin, the insertion member 2292 can be inserted inside the shell wall, so that the slot periphery of the slot 112 is interposed between the insertion member 2292 and the fresh air panel 21. When the thickness of the shell wall where the slot 112 is formed is thick, the receiving groove can be formed on the side wall of the slot 112. The insertion member 2292 is inserted in the receiving groove to ensure that the slot periphery of the slot 112 is interposed between the insertion member 2292 and the fresh air panel 21.

As such, by placing the tongue 229 on the inner surface of the fresh air panel assembly 20 and fully inserting the tongue 229 into the slot 112, the mating structure of the tongue 229 and the slot 112 can be prevented from interfering with the cooperation of the fresh air panel assembly 20 at other parts between the housings 10. Further, it is advantageous to improve the sealing between the fresh air panel assembly 20 and the housing 10 to avoid generation of abnormal sounds and condensation. In addition, it is also convenient to hide the tongue 229 and the slot 112, so that not only dust can be prevented, but also the aesthetics of the air conditioner indoor unit 100 can be improved.

Further, as shown in FIG. 17, the tongue 229 is disposed at a lower end of the fresh air panel assembly 20. In this way, the tongue 229 can be held in the slot 112 under the gravity of the fresh air panel assembly 20 itself, thereby improving the mounting stability of the fresh air panel assembly 20. The lower end of the fresh air panel assembly 20 refers to the lower end when the wall-mounted air conditioner indoor unit is mounted at the wall.

Further, as shown in FIGS. 18 and 19, the other end of the fresh air panel assembly 20 is connected to the housing 10 through the snap structure. The other end of the fresh air panel assembly 20 is connected to the unit panel 11 through the snap structure. As such, the other end of the fresh air panel assembly 20 can be detachably connected to the housing 10.

Specifically, a buckle 2030 is disposed at the inner side of the fresh air panel assembly 20.

Further, as shown in FIGS. 18 and 19, the other end of the fresh air panel assembly 20 is provided with a buckle 2030. The housing 10 is provided with a buckle hole (not shown), and the buckle 2030 is inserted in the buckle hole. Specifically, the buckle 2030 is disposed at the mounting plate 22, and the buckle hole is disposed at the unit panel 11.

Specifically, when the fresh air panel assembly 20 is a bending member, optionally, the buckle 2030 is a bending member provided on the fresh air panel assembly 20. In this way, the connection strength can be improved.

Thus, with the above structure, it is possible to connect both ends of the fresh air panel assembly to the housing 10, respectively, so that the fresh air panel assembly can be snapped onto the housing 10.

Further, as shown in FIGS. 18 and 19, a positioning guiding structure is disposed between the fresh air panel assembly 20 and the housing 10, and the positioning guiding structure is configured to position and guide the fresh air panel assembly 20. As such, the fresh air panel assembly 20 can be easily positioned when the fresh air panel assembly 20 is installed, thereby improving the installation efficiency of the fresh air panel assembly 20.

Specifically, the positioning guiding structure is disposed between the inner surface of the fresh air panel assembly 20 and the unit panel 11.

Further, as shown in FIGS. 18 and 19, one of the inner surface of the fresh air panel assembly 20 and the outer surface of the housing 10 is provided with a positioning protrusion 113, and the other is provided with a positioning groove 2031. In this way, the positioning guiding structure can be made simple and convenient to operate.

Specifically, the positioning protrusion 113 is disposed at the housing 10, and the positioning groove 2031 is disposed at the fresh air panel assembly 20. That is to say, the positioning protrusion 113 is provided on the outer surface of the unit panel 11, and the positioning groove 2031 is provided on the inner surface of the mounting plate 22.

Optionally, the positioning protrusion 113 is columnar, such as a cylindrical shape; and the positioning groove 2031 can be set as a circular groove.

In the air conditioner indoor unit 100 according to a second embodiment of the present disclosure, the fresh air panel assembly 20 is connected to the housing 10 through the snap structure and a magnetic device, the details are described below.

Further, as shown in FIGS. 20-23, one end of the fresh air panel assembly 20 is connected to the housing 10 by the snap structure. Specifically, one end of the fresh air panel assembly 20 is connected to the unit panel 11 through the snap structure. As such, one end of the fresh air panel assembly 20 can be connected to the housing 10.

Specifically, there are many specific forms of connection between one end of the fresh air panel assembly 20 and the housing 10, and reference may be made to the first embodiment of the air conditioner indoor unit 100, and details are not described herein.

Figure 21:
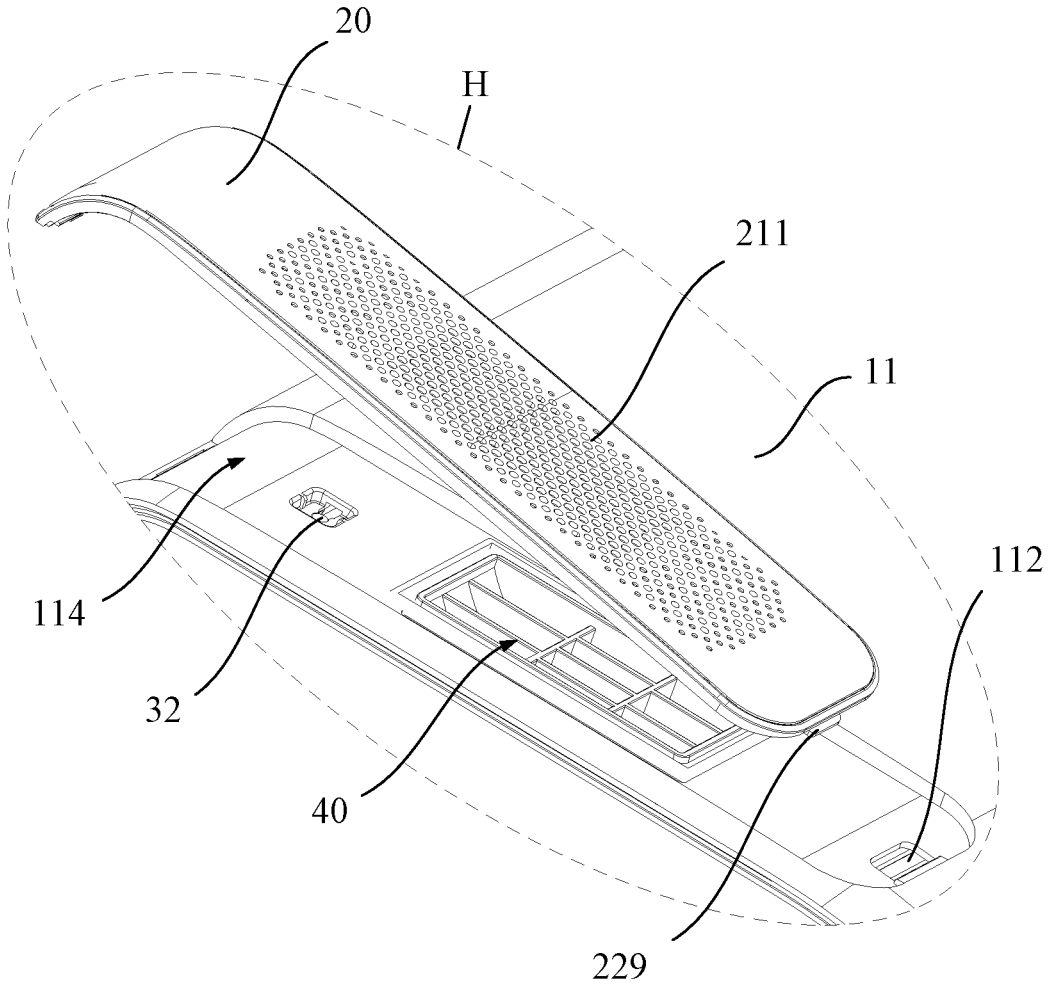
FIG. 21 is an enlarged view of portion H in FIG. 20.
Figure 22:
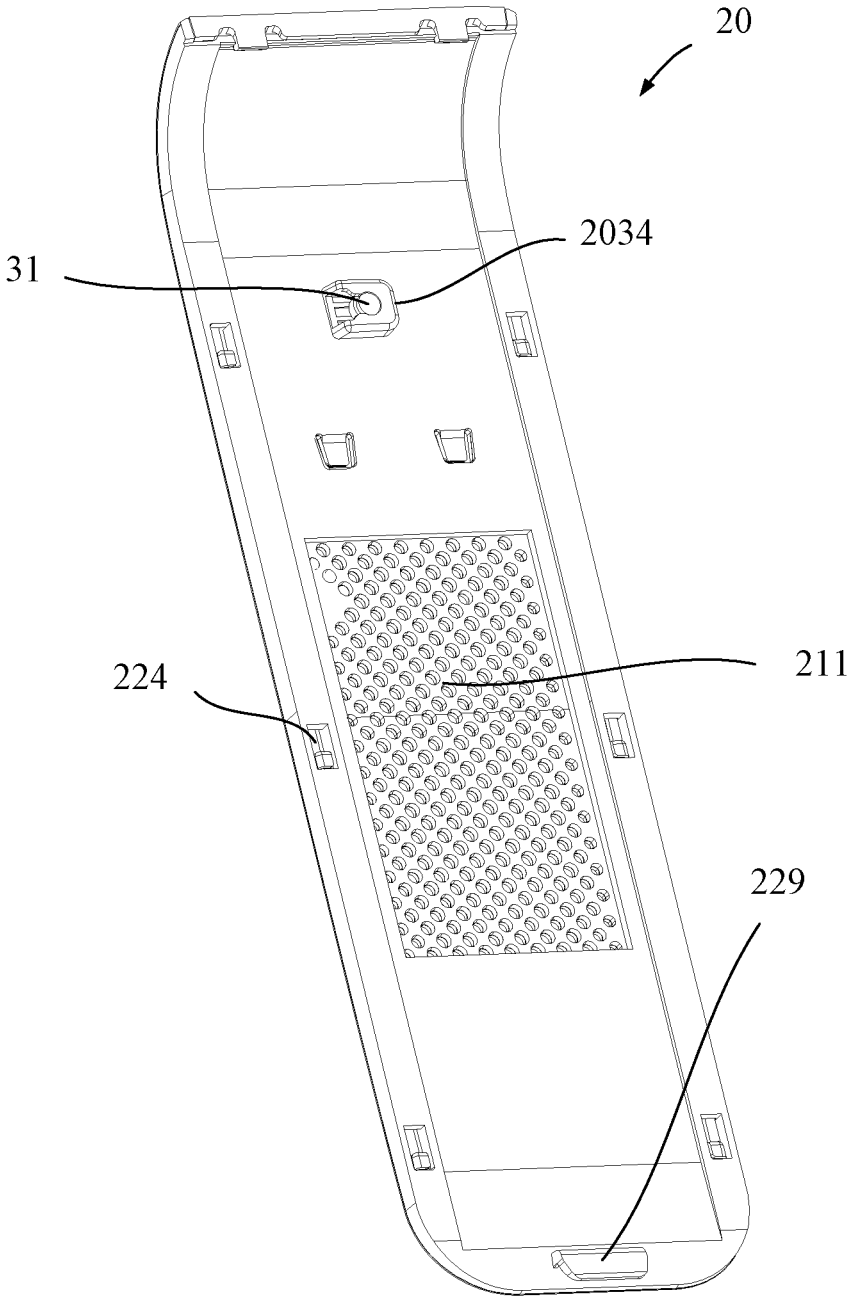
FIG. 22 is a schematic structural diagram of the fresh air panel assembly in FIG. 20.
Figure 23:
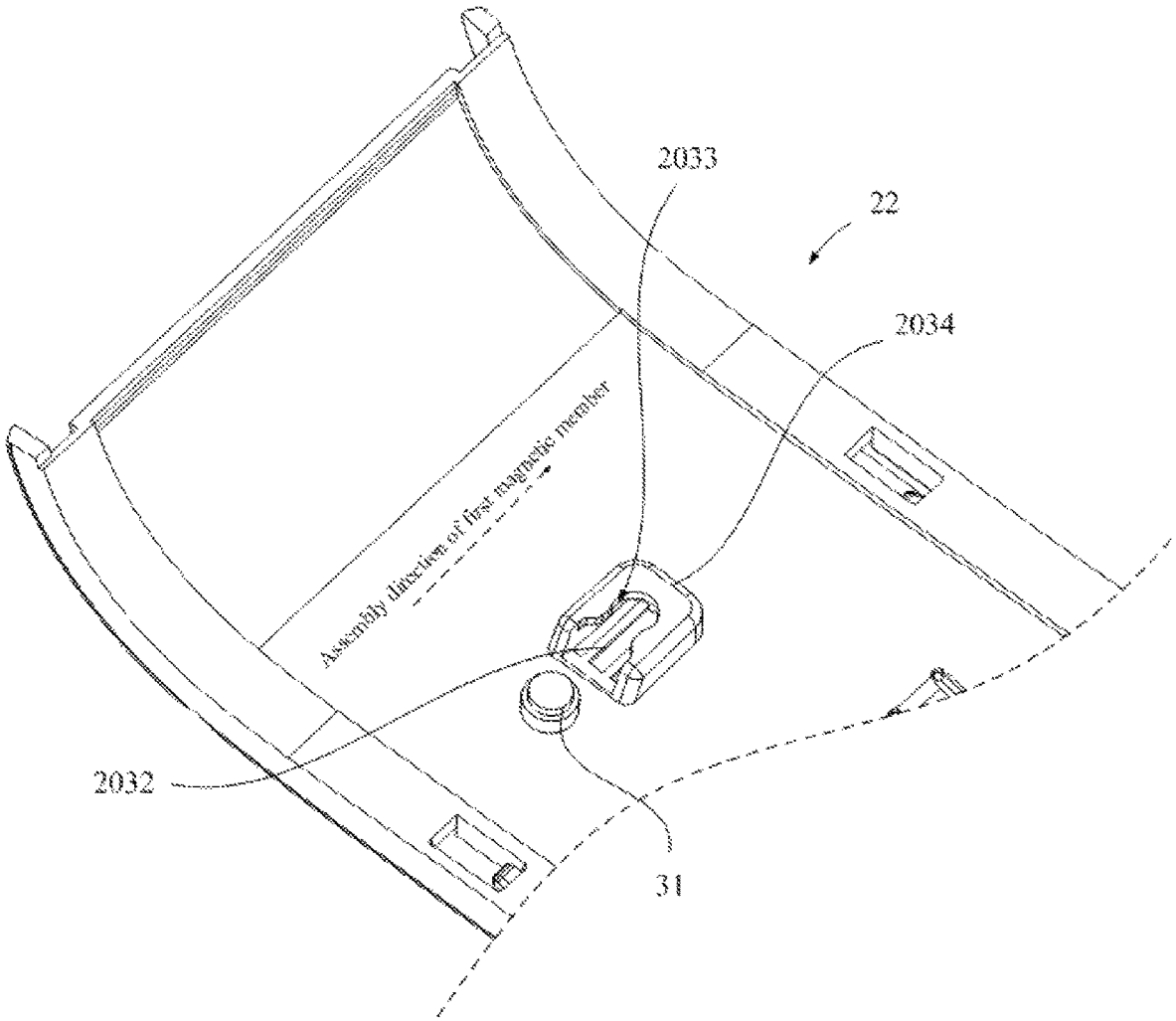
FIG. 23 is a partial structural diagram of the mounting plate in FIG. 22; the first magnetic member is in an assembled state.

Further, as shown in FIGS. 21-23, the other end of the fresh air panel assembly 20 is connected to the housing 10 through the magnetic device. Specifically, the other end of the fresh air panel assembly 20 is connected to the unit panel 11 through the magnetic device. As such, the connection between the other end of the fresh air panel assembly 20 and the housing 10 can be made simpler and more convenient.

Further, as shown in FIGS. 22 and 23, the inner surface of the fresh air panel assembly 20 is provided with a first magnetic member 31, and the housing 10 is provided with a second magnetic member 32 matching with the first magnetic member 31. Specifically, the first magnetic member 31 is disposed at the inner surface of the mounting plate 22, and the second magnetic member 32 is disposed at the unit panel 11.

Optionally, at least one of the first magnetic member 31 and the second magnetic member 32 is a magnet (permanent magnet); when one of them is a magnet, the other may be a metal member such as iron, nickel, or cobalt. In an embodiment, the first magnetic member 31 and the second magnetic member 32 are each provided as a magnet (permanent magnet).

Further, as shown in FIGS. 22 and 23, the inner surface of the fresh air panel assembly 20 is provided with a magnetic mounting position, and the first magnetic member 31 is mounted at the magnetic mounting position. Specifically, the magnetic mounting position is disposed at an inner surface of the mounting plate 22.

Further, as shown in FIGS. 22 and 23, the magnetic mounting position includes a laterally magnetic mounting groove 2032, and a side wall of the magnetic mounting groove 2032 opposite the inner surface of the fresh air panel assembly 20 is formed in the magnetic member through hole 2033. The magnetic member through hole 2033 extends through a side wall of the mounting groove opposite to the inner surface of the fresh air panel assembly 20. The first magnetic member 31 has a stepped structure and includes a thicker section and a thinner section. The thicker section is installed in the magnetic mounting groove 2032, and the thinner section is installed in the magnetic member through hole 2033.

Further, as shown in FIGS. 22 and 23, the magnetic mounting position further includes a magnetic mounting boss 2034 disposed at an inner surface of the fresh air panel assembly 20, and the magnetic mounting groove 2032 and the magnetic member through hole 2033 are both disposed at the magnetic mounting boss. In this way, the structure of the magnetic mounting position can be simplified.

Specifically, as shown in FIGS. 22 and 23, the magnetic mounting boss 2034 is provided on the inner surface of the mounting plate 22.

Specifically, as shown in FIG. 21, the mounting structure of the second magnetic member 32 on the housing 10 is similar to the mounting structure of the first magnetic member on the fresh air panel assembly 20, and detailed description thereof is not necessary herein. It can be understood that it can also make some adaptive changes.

It should be noted that since there is an attractive force between the first magnetic member 31 and the second magnetic member 32, the fresh air panel assembly 20 and the housing 10 have a natural positioning function, so that the positioning guiding structure is not added.

Figure 20:
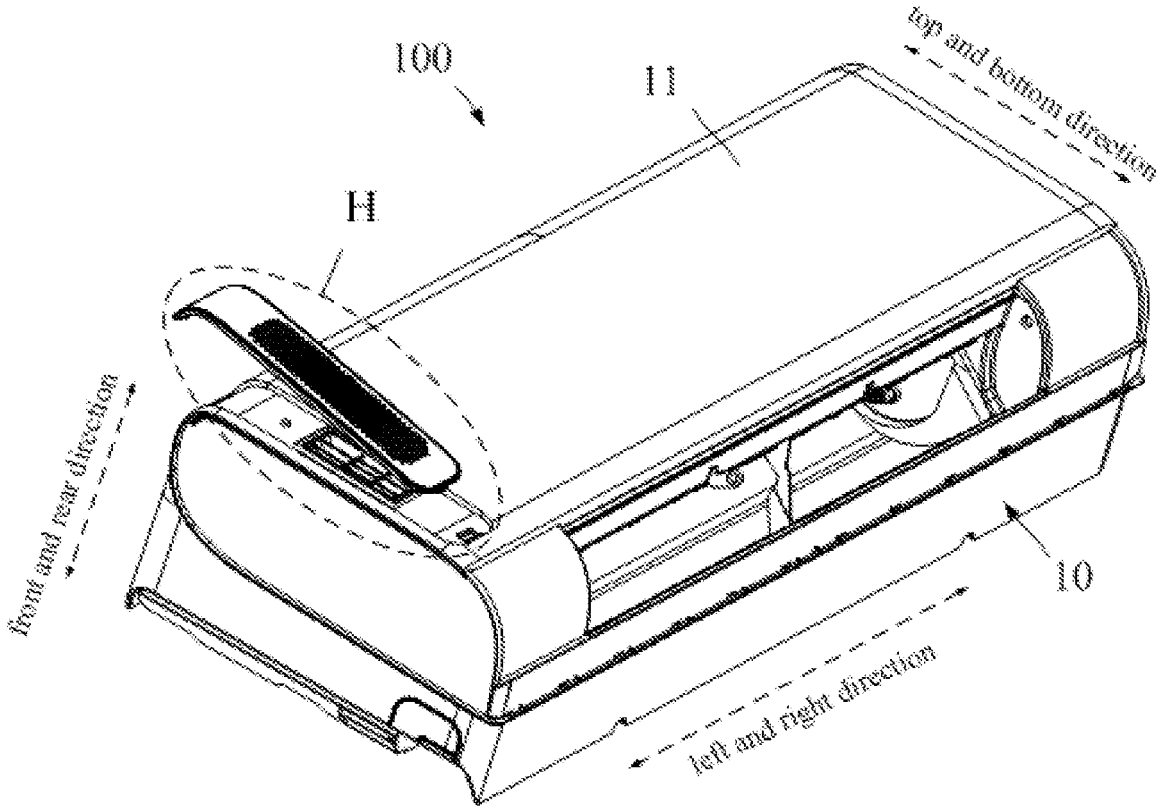
FIG. 20 is a schematic structural diagram of the air conditioner indoor unit according to a second embodiment of the present disclosure.

Further, as shown in FIGS. 18 and 20, the housing 10 is provided with a receiving groove 114, and the fresh air vent 111 is disposed at the bottom of the receiving groove 114; the fresh air panel assembly 20 is mounted in the receiving groove 114. As such, the fresh air panel assembly 20 can be hidden by providing the receiving groove 114 to install the fresh air panel assembly 20. Thereby, not only the risk of the fresh air panel assembly 20 being subjected to impact during handling or the like can be reduced, but the probability of damaging the fresh air panel assembly 20 can be reduced; and dust-proof can also be achieved.

Specifically, the receiving groove 114 is disposed at the unit panel 11.

Specifically, the outer surface of the fresh air panel assembly 20 is flush with the outer surface of the unit panel 11, or is nearly flush with the outer surface of the unit panel 11, or has a smooth transition with the outer surface of the unit panel 11, and the like.

Further, as shown in FIG. 3, the housing 10 is bent inward to form the receiving groove 114. As such, at least the structural strength of the housing 10 can be increased.

Specifically, the unit panel 11 is bent inward to form the receiving groove 114.

Specifically, as shown in FIGS. 18 and 20, the fresh air vent 111, the slot 112, and the positioning protrusion 113 are all disposed at the bottom of the receiving groove 114.

In other embodiments, it is also possible to realize that "the fresh air panel assembly 20 is disposed at the fresh air vent 111 in an openable manner" by other structural forms. Specifically, in the air conditioner indoor unit 100 according to a third embodiment of the present disclosure (not shown), the fresh air panel assembly 20 is rotatably connected to the housing 10 such that the fresh air panel assembly 20 is disposed at the fresh air vent 111 in an openable manner. The fresh air panel assembly 20 is rotatably connected to the unit panel 11.

Specifically, one side of the fresh air panel assembly 20 may be rotatably connected to the unit panel 11, and the side is the first side of the fresh air panel assembly 20.

It can be understood that the rotating connection structure of the fresh air panel assembly 20 and the unit panel 11 is easily conceivable by those skilled in the art and need not be detailed here.

Specifically, the fresh air panel assembly 20 is detachably connected to the housing 10 at a position away from the first side of the fresh air panel assembly 20. In this way, the fresh air panel assembly 20 can be fixed.

Further, the fresh air panel assembly 20 is detachably connected to the housing 10 at a second side thereof; the second side of the fresh air panel assembly 20 is disposed opposite to the first side of the fresh air panel assembly 20. Thus, not only the connection structure between the fresh air panel assembly 20 and the housing 10 can be simplified, but also the connection stability between the fresh air panel assembly 20 and the housing 10 can be improved.

Specifically, the detachable connection structure between the fresh air panel assembly 20 and the housing 10 is easily conceivable by those skilled in the art, and need not be detailed herein.

Optionally, the first side of the fresh air panel assembly 20 is an upper side, or a left side, or a right side of the fresh air panel assembly 20. As such, when the fresh air panel assembly 20 is opened, the fresh air panel assembly 20 can be prevented from interfering with its own cleaning. Of course, the first side of the fresh air panel assembly 20 can also be the lower side of the fresh air panel assembly 20.

Figure 24:
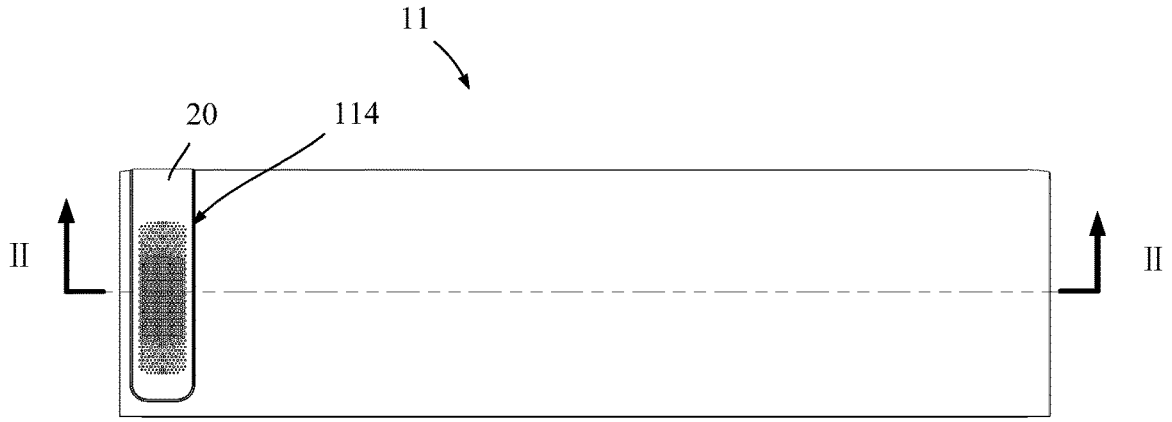
FIG. 24 is a top view of the unit panel in FIG. 1.
Figure 25:
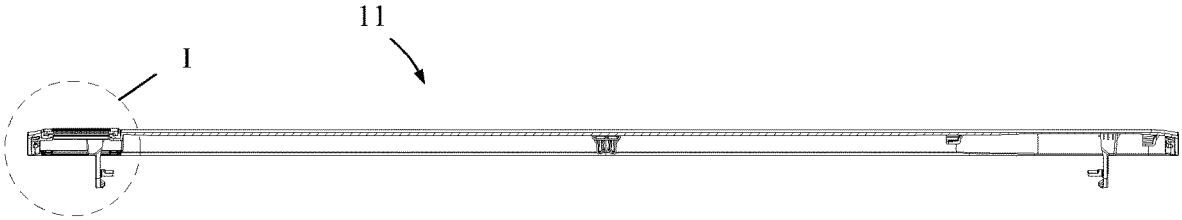
FIG. 25 is a cross-sectional view of the unit panel taken along line II-II in FIG. 24.
Figure 26:
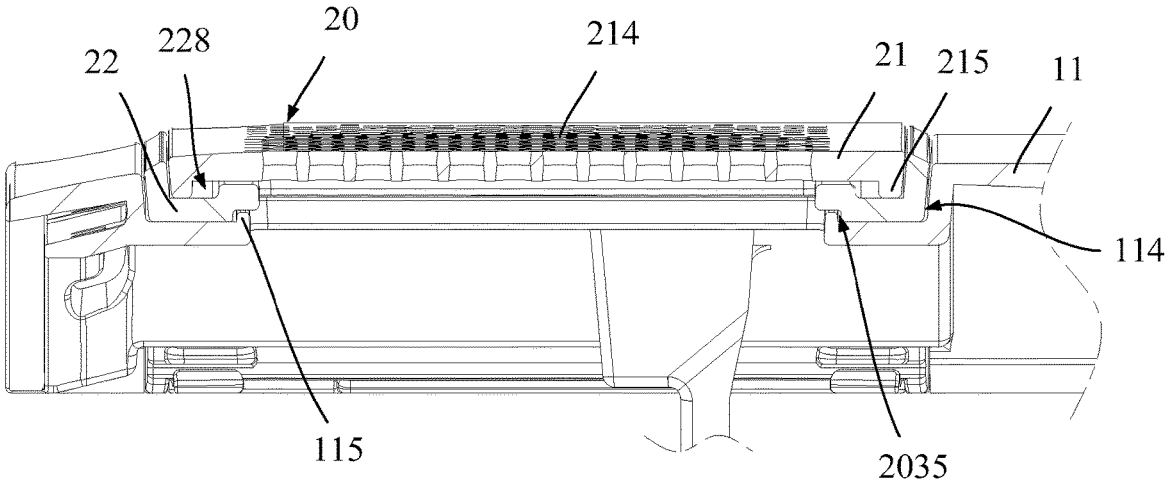
FIG. 26 is a partial enlarged view of portion I in FIG. 25.

Further, as shown in FIGS. 24-26, a sealing structure is provided between the fresh air panel assembly 20 and the housing 10, and the sealing structure is configured to improve the seal between the fresh air panel assembly 20 and the housing 10. In this way, the fresh air delivered by the fresh air module 40 can be prevented from leaking between the fresh air panel assembly 20 and the housing 10. Therefore, not only the loss of fresh air and air volume can be reduced, the ventilation capacity of the air conditioner indoor unit 100 can be improved, and the abnormal sound and/or condensation generated when the fresh air leaks can be avoided.

Further, as shown in FIG. 26, the sealing structure includes a sealing ring protrusion 115 and a sealing ring groove 2035; the sealing ring protrusion 115 is a protrusion extending in a ring shape, and the sealing ring groove 2035 is a groove extending in an annular shape. Specifically, one of the sealing ring protrusion 115 and the sealing ring groove 2035 is disposed at an inner surface of the fresh air panel assembly 20, and the other is disposed at an outer surface of the housing 10. The sealing ring protrusion 115 is disposed at a periphery side of the fresh air vent 111, and the sealing ring protrusion 115 is installed in the sealing ring groove 2035. As such, the sealing between the fresh air panel assembly 20 and the housing 10 can be improved; and the structure of the sealing structure is simple and the assembly is convenient.

Specifically, the sealing ring protrusion 115 is disposed at an outer surface of the housing 10, and the sealing ring groove 2035 is disposed at an inner surface of the fresh air panel assembly 20. The sealing ring protrusion 115 is disposed at the surface of the unit panel 11, and the sealing ring groove 2035 is disposed at the inner surface of the mounting plate 22.

Further, the end of the sealing ring protrusion 115 abuts against the bottom of the sealing ring groove 2035. In this way, the sealing effect can be further improved.

Further, the sealing ring groove 2035 laterally communicates with the vent 221. In this way, the sealing effect can be further improved.

Of course, the sealing structure can also be configured in other structural forms, and need not be repeated here.

The present disclosure provides an air conditioner. The air conditioner includes an outdoor unit (not shown) and an indoor unit. As shown in FIGS. 1-26, the specific structure of the air conditioner indoor unit 100 refers to the above embodiments. Since all the technical solutions of all the above embodiments are adopted in the air conditioner, at least all the effects brought by the technical solutions of the above embodiments are not described herein.

Optionally, the indoor unit 100 is connected to the outdoor unit through a refrigerant pipe.

The above are only alternative embodiments of the present disclosure, and thus do not limit the scope of the present disclosure. The equivalent structure or equivalent process transformations made by the present specification and the drawings are directly or indirectly applied to other related technical fields, and are included in the scope of the present disclosure.

What is claimed is:

1. An air conditioner indoor unit housing having a fresh air module configured to deliver fresh air to a room, the housing comprising at least one air inlet, and at least one air outlet;

the housing further comprising a unit panel having a fresh air panel assembly, the fresh air panel assembly comprising:

a fresh air panel including an air outlet structure;

a mounting plate including:

a vent penetrating through the mounting plate; and a positioning groove;

wherein:

the fresh air panel is mounted at a first surface of the mounting plate;

the vent is arranged corresponding to the air outlet structure; and the positioning groove is located on a second surface of the mounting plate, the second surface of the mounting plate being opposite to the first surface of the mounting plate, the positioning groove configured to receive a positioning protrusion, the positioning protrusion located on an outer surface of the housing; and wherein:

the fresh air panel assembly is a bending member, curving at a top end of the fresh air panel assembly; and/or one of the fresh air panel and the mounting plate is provided with a reinforcement rib, an another one of the fresh air panel and the mounting plate is provided with a reinforcement groove, and the reinforcement rib is disposed in the reinforcement groove when the fresh air panel and the mounting plate are in an assembled state.

2. The fresh air panel assembly of claim 1, wherein a surface of the fresh air panel facing the mounting plate is attached to the first surface of the mounting plate, the first surface of the mounting plate includes an outer surface of the mounting plate, and the fresh air panel is mounted at the outer surface of the mounting plate.

3. The fresh air panel assembly of claim 2, wherein:

the mounting plate includes:

a base plate including the vent; and a side plate disposed at an outer surface of the base plate;

the outer surface of the mounting plate includes the outer surface of the base plate; and the fresh air panel is mounted at the outer surface of the base plate and located at an inner side of the side plate.

4. The fresh air panel assembly of claim 3, wherein the side plate is disposed at an edge of the base plate.

5. The fresh air panel assembly of claim 1, wherein the fresh air panel is connected to the mounting plate through a snap structure, and the snap structure includes a clamp structure.

6. The fresh air panel assembly of claim 5, wherein the clamp structure comprises a clamp protrusion and a clamp hole, and wherein an inner side surface of the fresh air panel is provided with the clamp protrusion, and the mounting plate is provided with the clamp hole, and the clamp protrusion is fitted in the clamp hole.

7. The fresh air panel assembly of claim 6, wherein the fresh air panel clamp protrusion includes:

a connection protrusion protruding from an inner surface of the fresh air panel; and a limit protrusion laterally protruding from the connection protrusion and facing the fresh air panel;

the connection protrusion, the limit protrusion, and the fresh air panel cooperatively form a clamp groove; and wherein the mounting plate includes a latch protrusion and a mounting gap, the latch protrusion protrudes from an inner side wall of the clamp hole and, when connected with the clamp protrusion, is clamped in the clamp groove, and wherein the mounting gap being formed between the latch protrusion and the inner side wall of the clamp hole.

8. The fresh air panel assembly of claim 7, wherein:

the clamp protrusion further includes a reinforcement protrusion protruding from the inner surface of the fresh air panel, and is connected to the limit protrusion and the fresh air panel; or the latch protrusion extends along a length direction of the fresh air panel assembly.

9. The fresh air panel assembly of claim 5, wherein one of an inner side surface of the fresh air panel and the first surface of the mounting plate is provided with an anti-falling protrusion, and another one of the inner side surface of the fresh air panel and the first surface of the mounting plate is provided with an anti-falling groove, and the anti-falling protrusion is inserted in the anti-falling groove.

10. The fresh air panel assembly of claim 9, wherein:

the anti-falling protrusion is disposed at the inner side surface of the fresh air panel, and the anti-falling groove is formed at the first surface of the mounting plate; and the first surface of the mounting plate is further provided with an alignment groove near the anti-falling groove, and the alignment groove is configured to guide the anti-falling protrusion to slide into the anti-falling groove.

11. The fresh air panel assembly of claim 10, wherein:

the alignment groove has a guiding inner side wall near the anti-falling groove, and at least a part of the guiding inner wall surface is inclined towards the anti-falling groove; and/or a depth of the alignment groove is less than a depth of the anti-falling groove; and/or the anti-falling groove has a guiding outer side surface facing away from a side of the alignment groove, at least a part of the guiding outer side surface is inclined towards the alignment groove; and/or the anti-falling protrusion is strip shaped.

12. The fresh air panel assembly of claim 5, wherein:

the inner side surface of the fresh air panel is provided with a hook including:

a support protrusion protruding from the inner side surface of the fresh air panel; and a blocking protrusion laterally protruding from the support protrusion; and the support protrusion, the blocking protrusion, and the fresh air panel cooperatively form a hook groove, and a side of the mounting plate is clamped in the hook groove.

13. The fresh air panel assembly of claim 12, wherein:

a side surface of the blocking protrusion facing towards the inner side surface of the fresh air panel is provided with an anti-disengagement groove, the side of the mounting plate is provided with an anti-disengagement protrusion, and the anti-disengagement protrusion is fitted in the anti-disengagement groove; and/or the hook is one of a plurality of hooks provided at the side of the mounting plate in an extension direction of the mounting plate; and/or the hook is disposed at a short side of the fresh air panel.

14. The fresh air panel assembly of claim 1, wherein:

an anti-falling protrusion is disposed at an inner side surface of the fresh air panel, an anti-falling groove is formed at the first surface of the mounting plate, the anti-falling protrusion is inserted in the anti-falling groove;

the first surface of the mounting plate is further provided with an alignment groove near the anti-falling groove, and the alignment groove is configured to guide the anti-falling protrusion to slide into the anti-falling groove; and the anti-falling groove has a guiding outer side surface facing away from a side of the alignment groove, and at least a part of the guiding outer side surface is inclined towards the alignment groove.

15. The fresh air panel assembly of claim 1, wherein:

an inner side surface of the fresh air panel is provided with a plurality of hooks at the side of the mounting plate in an extension direction of the mounting plate;

each of the plurality of hooks includes:

a support protrusion protruding from the inner side surface of the fresh air panel; and a blocking protrusion laterally protruding from the support protrusion; and the support protrusion, the blocking protrusion, and the fresh air panel cooperatively form a hook groove, and a side of the mounting plate is clamped in the hook groove.

16. The fresh air panel assembly of claim 1, wherein the fresh air panel assembly is the bending member, the fresh air panel assembly has a first side and a second side, the first side is longer than the second side, and one end of the first side of the fresh air panel is bent along an extension direction of the first side of the fresh air panel.

17. An air conditioner indoor unit housing comprising:

a unit panel, and a fresh air panel assembly;

the housing having a positioning protrusion located on an outer surface of the housing;

the unit panel having a fresh air outlet formed therein with the fresh air panel assembly disposed at the fresh air outlet;

wherein the fresh air panel assembly comprising:

a fresh air panel including an air outlet structure; and a mounting plate including a vent penetrating through the mounting plate, and including a positioning groove;

wherein:

the fresh air panel is mounted at a first surface of the mounting plate;

the vent is arranged corresponding to the air outlet structure;

the positioning groove is located on a second surface of the mounting plate, the second surface of the mounting plate being opposite to the first surface of the mounting plate, and the positioning protrusion is disposed in the positioning groove when the mounting plate is connected to the housing;

the first surface of the mounting plate includes an outer surface of the mounting plate, and the fresh air panel is mounted at the outer surface of the mounting plate;

the mounting plate further includes:

a base plate including the vent; and a side plate disposed at an outer surface of the base plate;

the outer surface of the mounting plate includes the outer surface of the base plate; and the fresh air panel is mounted at the outer surface of the base plate and located at an inner side of the side plate; and wherein:

the fresh air panel assembly is a bending member; and/or one of the fresh air panel and the mounting plate is provided with a reinforcement rib, an another one of the fresh air panel and the mounting plate is provided with a reinforcement groove, wherein the reinforcement rib is disposed in the reinforcement groove when in an assembled state.

18. An air conditioner indoor unit housing configured to deliver fresh air to a room, the housing comprises a unit panel including a fresh air outlet, and a fresh air panel assembly, wherein the fresh air panel assembly is mounted at the housing to cover the fresh air outlet, the fresh air panel assembly comprising:

a fresh air panel including an air outlet structure; and a mounting plate including:

a vent penetrating through the mounting plate, and a positioning groove;

wherein:

the housing including an outer surface, wherein a positioning protrusion located on the outer surface;

the fresh air panel is mounted at a first surface of the mounting plate;

the mounting plate vent is arranged corresponding to the air outlet structure;

the positioning groove is located on a second surface of the mounting plate to receive the positioning protrusion of the housing, the second surface of the mounting plate being opposite to the first surface of the mounting plate; and the fresh air panel is connected to the mounting plate through a snap structure, and the snap structure includes a clamp structure; and wherein:

the fresh air panel assembly is a bending member, curving at the top end of the fresh air panel assembly; and/or one of the fresh air panel and the mounting plate is provided with a reinforcement rib, an another one of the fresh air panel and the mounting plate is provided with a reinforcement groove, and the reinforcement rib is disposed in the reinforcement groove, when in an assembled state.

* * * * *